US007198341B1

(12) United States Patent
Rast

(10) Patent No.: US 7,198,341 B1
(45) Date of Patent: Apr. 3, 2007

(54) ENHANCED ELECTRONIC INK DISPLAYS

(76) Inventor: Rodger H. Rast, Raster Corporatyion 11230 Gold Express Dr. Suite 310 MS 337, Gold River, CA (US) 95670

( * ) Notice: Subject to any disclaimer, the term of this patent is extended or adjusted under 35 U.S.C. 154(b) by 296 days.

(21) Appl. No.: 10/612,221

(22) Filed: Jul. 1, 2003

Related U.S. Application Data

(60) Provisional application No. 60/394,160, filed on Jul. 1, 2002.

(51) Int. Cl.
*B41J 3/00* (2006.01)
*G09G 5/00* (2006.01)

(52) U.S. Cl. ..... 347/4; 345/179

(58) Field of Classification Search ..... 347/230, 347/241, 256, 4, 224–225, 247, 251; 345/2, 345/55, 87, 179
See application file for complete search history.

(56) References Cited

U.S. PATENT DOCUMENTS 6,753,830 B2 * 6/2004 Gelbman ..... 345/55

* cited by examiner

*Primary Examiner*—Hai Pham
(74) *Attorney, Agent, or Firm*—Rodger H. Rast

(57) ABSTRACT

An apparatus for rewritably labeling data media, such as compact disks CDs, DVDs, or other forms of media. The media may be programmed within a player/recorder device adapted for programming the state of the electronic ink material on the media. Labels on the media may be rewritten at any time without the need to remove a prior label. A small handheld label printing device is also described for writing the labels. Numerous other display embodiments particularly suited to electronic ink, and various embodiments of LED array control.

12 Claims, 21 Drawing Sheets

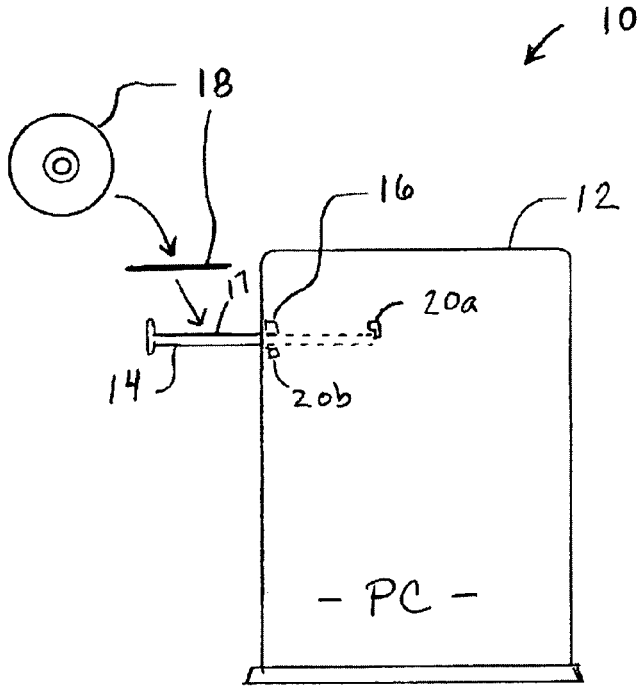
FIG. 1
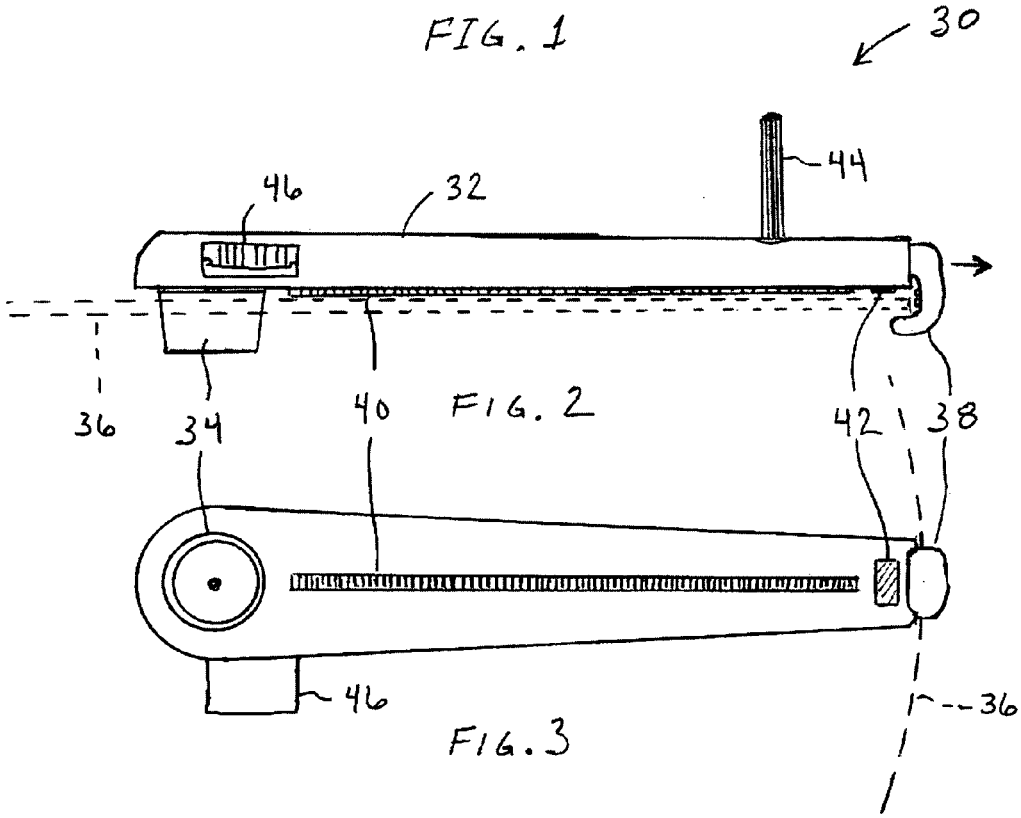
FIG. 2
FIG. 3

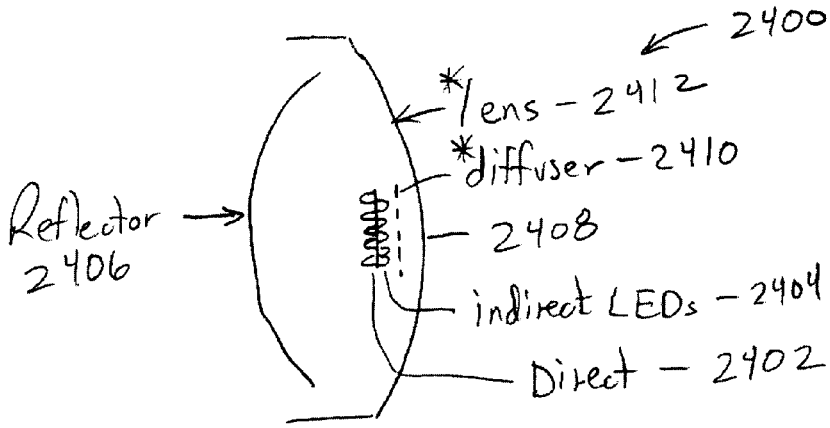
FIG. 35
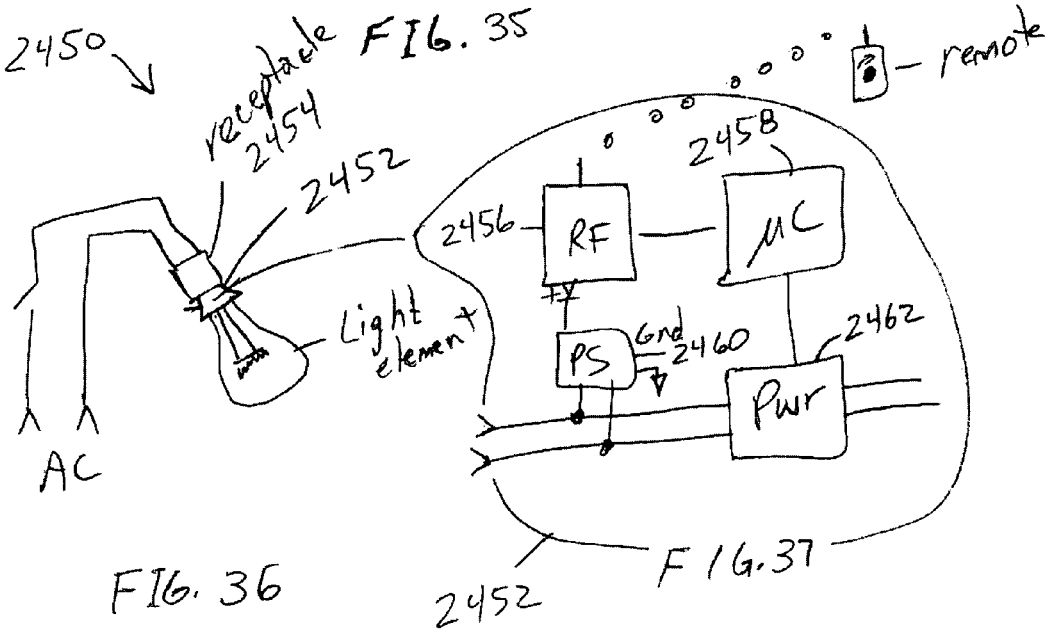
FIG. 36
FIG. 37

ENHANCED ELECTRONIC INK DISPLAYS

CROSS-REFERENCE TO RELATED APPLICATIONS

This application claims priority from U.S. provisional application Ser. No. 60/394,160 filed on Jul. 1, 2002.

STATEMENT OF FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to displays and more particularly to a method and system for labeling removable media.

2. Description of the Background Art

In order to mark media such as CDs, DVDs, tapes and the like, the user has been required in the past to purchase specialized labels, print the label such as on a printer, and then adhere the label to the media. This process is time consuming and there is no easy way to replace the label with an updated one, especially when rewritable media is utilized. The present system and method provides these capabilities.

SUMMARY OF THE INVENTION

To provide a low cost method and system for marking Media. The system utilizes eInk, or another form of non-volatile display programmed with voltage field, retained on a media in combination with an electrode plane, that when utilized with a writing device containing a set of electrodes and a connection for the electrode plane allow setting the pixels of the eInk to a desired state, thus writing on the media. The media may be printed upon within a separate device, although the invention provides an apparatus wherein the media may be labeled when recorded or otherwise retained within a player.

An aspect of the invention is to provide a convenient means for writing labels on storage media.

An aspect of the invention is to provide a media which can be easily label with a rewritable label.

Another aspect of the invention is to provide a method of rewriting labels such as on rewritable media.

Another aspect of the invention is to provide a means of writing media that can be performed on the fly within a media recording device.

Another aspect of the invention is to provide a means of writing media that can be performed with an inexpensive and portable device.

Further aspect and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 1 is a side view of a computer device (e.g., PC) configured with an electronic ink media print mechanism according to an embodiment of the present invention.

FIG. 2 is a side view of a rotating label writing device according to an embodiment of the present invention.

FIG. 3 is a top view of the rotating label writing device of FIG. 2.

FIG. 35 is a side view of a remotely controlled lighting assembly according to an embodiment of the present invention, shown with integral receiver.

FIG. 36 is a side view of a remotely controlled lighting assembly according to an another aspect of the present invention.

FIG. 37 is a schematic of a remotely controlled lighting assembly according to an aspect of the present invention.

DETAILED DESCRIPTION OF EMBODIMENT(S)

Figure 4:
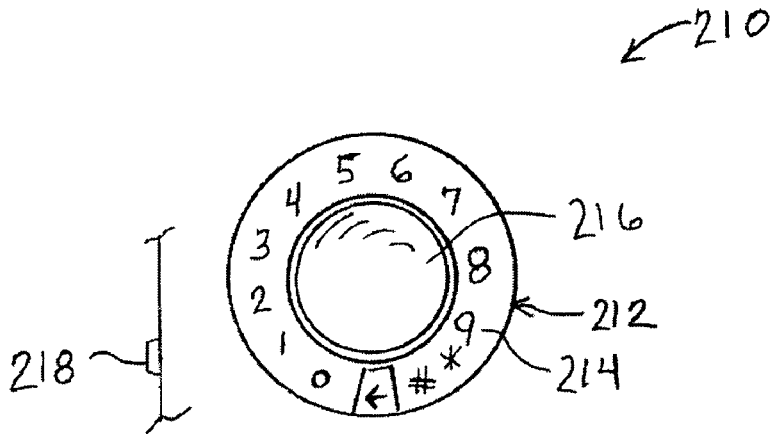
FIG. 4 is a top view of a circular button selector according to an embodiment of the present invention, showing a first legend context.

Referring more specifically to the drawings, for illustrative purposes the present invention is embodied in the apparatus generally shown in FIG. 1 through FIG. 42.

Illustrative embodiment(s) of the invention are described herein and depicted in the drawings, the invention is susceptible of embodiment in many forms and it should be understood that the present disclosure is to be considered as an exemplification of the principle aspects of the invention and is not intended to limit the invention to the embodiment(s) illustrated. Various aspects, modes, embodiments, variations, and features may be described throughout the specification which need not be implemented to practice aspects of the invention. Furthermore, preferred elements of the invention may be referred to whose inclusion is generally optional, limited to specific applications or embodiment, or with respect to desired uses, results, cost factors and so forth.

Throughout the specification numerous values and type designations may be provided for the elements of the invention in order that a complete, operable, embodiment of the invention be disclosed. However, it should be understood that such values and type designators are merely representative and are not critical unless specifically so stated. The scope of the invention is not limited to one or more specific exemplifications within a described embodiment.

The present system and method may be implemented in a number of ways, however, the following is limited to descriptions of one or more preferred embodiments of the invention that may be readily practiced and easily understood. It should be appreciated, however, that one of ordinary skill in the art can modify these embodiments, especially in view of the teachings found herein, to implement a number of variations on the embodied invention without the need for creative effort and without departing from the teachings of the invention as described and/or claimed.

1.0 eInk—Method and System for Labeling Removable Media.

This application incorporates by reference the additional electronic ink embodiments referred to in patent application entitled "A System and Methods of Maintaining Consumer Privacy During Electronic Transactions" Ser. No. 10/066,495 filed Feb. 2, 2002 and provisional application entitled "Display Systems and Methods Utilizing Electronic Ink" Ser. No. 60/267,115 filed Feb. 7, 2001.

Electronic ink may be statically programmed using voltage fields from nearby electrodes to change the color state of the ink from a first state to a second state, or back again to the first state. By passing pixel electrodes over a surface of electronic ink under which a separate opposing power plane exists, the areas of the electronic ink may be written to. The present invention utilizes these effects for printing rewritable labels on media. The method and system of the invention is particularly well suited for use with rewritable media as both the contents and labels may be easily rewritten. The following will describe a few embodiments of the invention.

1.1 Media with Electronic Ink Writable Area.

The following description is based on a DVD or CD style media of any size. It will be appreciated that labels for any form of media having a regular surface may be printed using the present invention, thereby allowing the label to be rewritten at any time without the burden and mess of removing paper or ink adhered to the media surface.

Media according with the present invention is configured with a first conductive plane (i.e. ground plane) over which electronic ink is deposited, and a sealing layer that may be optionally overlaid over the ink layer for protection and aesthetics. Optionally a second transparent electrode grid may be placed coupled to the top of the media allowing the entire portion of the electronic ink to be set or reset at once, or at least regions sandwiched between the opposing large area electrodes in response to a programming voltage field.

To simplify making contact with the conductive layer, it may be extended into the center spindle and/or the perimeter. Furthermore, the conductive layer may be extended to at least a portion of the opposing side of the disk, such as near the center spindle hole or the perimeter. In this way electrical contact may be established with the conductive layer from either side of the disk depending on the construction of the printing device. Although the disk can be contacted on any portion of the electrode, this method eliminates the possibility of subjecting the data areas on the surface of the disk to damage, such as if a disk were to be incorrectly inserted with the data side in the incorrect direction, or on disks having data stored on both sides with printing being performed on only a portion of the surface such as on a ring about the spindle hole.

Optionally, rotational angle marks may be encoded onto the disk so that the position of the disk can be readily discerned when being "printed". By way of example a series of optically responsive markers, such as pits, color bands, dots, and so forth are aligned at a fixed spacing on the outer, or inner, perimeter of the top surface. These angle marks may be alternatively, or additionally, located on the underside of the disk. These marks can be used for synchronizing the output to the electrode bar with the surface of the CD/DVD when being written.

It should be appreciated that it may be desirable in some thin forms of media to eliminate the underlying electrode, wherein an additional area electrode is provided on the writing device which is retained sufficiently close to the media to allow the electronic ink to be written to with a voltage field output on opposing sides of the media.

1.2 Player/Duplicator Media Carrier with eInk Printing Head.

FIG. 1 depicts a personal computer 10 configured for receiving CD/DVD or similar planar media. By way of illustration, computer 10 has a housing 12 out of which a disk carrier 14 extends for receiving or ejecting a planar media such as a CD-ROM, R/W CD, DVD, R/W DVD, and so forth. It should be appreciated that this slide loading media player/recorder may be implemented within devices other than computers, such as laptop computers, media duplicators, home entertainment systems, personal stereos, audio and video recorder systems, media playback systems, systems for generating media for backing up computers, and other devices for accepting forms of media having eInk pixels near at least one surface to be written upon.

The present invention incorporates an electrode bar 16 and background electrode 17 configured for "printing" on a planar media having a surface containing electronic ink, or similar composition having areas that can be set to a first or second optical state in response to the application of a sufficient electric field. Electrode bar 16 is configured with a series of separate electrodes that may be set to a voltage that is above or below the voltage of background electrode 17 for programming the pixels in the eInk to either a first or second state.

Background electrode 17 may be retained at a fixed voltage or it may be varied with a voltage that depends on whether the disk is to be written to a first state or a second state.

As disk 18 (a media according to the present invention with electronic ink surface) within carrier 14 is retracted into the housing 12, or is ejected from housing 12, the electrodes write a label on the surface of disk 18 by modulating the voltages on the electrode with respect to the background electrode the time spent per pixel being dependent on the velocity of travel for the tray.

A sensor assembly 20*a*, 20*b* can be utilized for indicating to the software when the tray is open and when closed. The software preferably maintains a time value for the motion of the tray that can be divided by pixel pitch, with offsets for spacing on either side of the media. The software can thus modulate the voltage on the elements of the electrode bar at the proper timing to label the surface of the media. The drive may additionally register the actual travel rate wherein write speed to the eInk is matched to actual travel which can prevent irregular spacing particularly on older drives.

Programming executing on the system allows the user to enter label information, or to accept label information written in other programs, for example a text and graphics file written in a word processor. The programming may be contained in a separate application program or it may be integrated within a routine configured for accessing the media, in particular a program which allows writing data to the media. The present invention allows the disk to be relabeled whenever it is written, or otherwise at the discretion of the user since the data need not be written to allow a label to be written on the media.

The example above illustrates the use of slide drawer that linearly draws (moves) the media over an electrode array (bar), however, it should be appreciated that the media may be drawn in a circular pattern over the electrode with similar effect.

1.3 Rotating Label Writing Device.

FIG. 2 and FIG. 3 illustrate an example of a separate media printing device 30 that is configured for being rotated about the central hole of the media while it programs the pixels on the surface of the disk to at least first and second states thereby printing a preferably non-volatile label on the media. A housing 32 is shown with a tapered spindle 34 extending from a distal end for insertion within a central aperture within a media 36. The proximal end is optionally configured with a combination tensioner and background electrode contact 38, which retains the media in the proper orientation with an electrode array 40, and can be used to make contact with the opposing electrode retained beneath the electrically programmable pixels, such as the eInk. It should be appreciated that the tensioner may be configured to extend from the sides of housing 32 to allow printing a label on media that has a smaller than the traditional diameter, for example the credit card sized media being increasingly utilized for business cards. A wheel 42 is shown near the proximal end of electrode bar 40 to allow the media to be rotated smoothly while held proximal to the electrodes within the bar. Wheel 42 may be conductive and configured for making contact with the background electrode. Furthermore wheel 42 may be coupled to a sensor for sensing the rotation of the media for controlling the rate at which pixels are programmed to display at least a first or second optical state.

A rotation stem 44 is shown extending near the proximal end of device 30 as a convenient means for the user to grasp the device and rotate it about media 18. Stem 44 preferably is configured to rotate so it is subject to less friction between the user's fingers in response to rotation. Alternatively stem 44 may be non-rotating but configured with a smooth exterior that easily slips on the user's skin under rotation. A sensor may be coupled to a rotating stalk to sense the motion of the printing unit over the media for controlling the rate at which pixels are programmed.

A programming port 46 is shown, herein exemplified as a USB port. The unit may be alternately configured to communicate with a source of pixel programming using any convenient communications medium, such as Firewire™, IR, RFID, wireless, R-232, or any other means of transferring data from a host system.

The printing device may be powered from any convenient source of power, such as batteries, fuel cells, capacitors, solar cells, inductive charging, power drawn through the programming port, and so forth. This embodiment draws power from the USB port during programming to charge a capacitor that supplies programming power. A battery may be used in the unit for retaining device memory if that is important for a given application.

The embodiment is shown having a USB port through which power and programming are loaded into the device. The device is shown as a separate unit, however it may be implemented for accepting a USB memory device wherein the unit itself need not contain much memory or a USB interface. This can be performed in a similar manner that some current MP3 players are connected to a USB memory unit that has been loaded with MP3 tunes.

To use the device, the device is connected to a programming source and the printer memory is programmed to the desired pattern, such as on a personal computer, laptop computer, PDA, or other electronic device configured for generating a desired label pattern. Preferably, application software is provided on a target machine, such as a PC, that allows the user to create a label using an interface similar to a word processing interface. Once created, the data is converted to a bitmap pattern following a polar pattern for loading into the device. It will be appreciated that using a polar pattern allows the device to directly modulate the pixels in response to rotational movement wherein it need not transform Cartesian coordinates to polar coordinates on the fly.

Once loaded the user locks it into the center hub, and then uses a handle to rotate it about the disk. The rotation of the handle can be sensed as the angular speed of the device for synchronizing the writing pixels comprising the label onto the surface. In this way the disks need not have any angular markings present on the disk.

1.4 Other Aspects.

1.4.1 Incorporate within Other Forms of Players.

The techniques described above may be utilized for printing a pattern on eInk coated media within a number of different record or playback devices. By way of example a top loading media player may incorporate an electrode bar similar to that of FIG. 2 and FIG. 3, wherein the media is rotated by hand, or using a crank or similar input device, when held against the electrode bar to write a label on the media. For example, pressing in on a crank handle can lower the spindle and engage a peripheral edge wheel that transfers rotation from the crank to the media thus by sensing crank rotation the pixels on the media surface can be written to at the proper rate to create the desired label pattern.

Alternatively, a separate spindle may be incorporated within the lid of the device for programming the pixels. It should be recognized that a number of similar methods for moving the media in relation with the electrode bar will be apparent to one of ordinary skill in the art without departing from the teachings of the present invention.

1.4.2 Other Forms of Media.

The technique described above may be utilized with other forms of media, such as credit cards, smart cards, memory cards, memory sticks, USB based devices, tape cassette, video cassettes and so forth. It will be appreciated that the pixels of eInk or similar are joined over a background electrode that is accessible to the writer, and the surface of the label being slid across a pixelated electrode (electrode bar with individually controllable electrodes the width of a pixel), as the pixel electrode voltages are modulated according to a pattern suited to the label being printed.

1.4.3 Voice Input Printing,

Label printing according to the invention may be configured to generate pixel programming for a label in response to other forms of input that is converted to a pixel bitmap. By way of example voice input may be utilized to enter text that is to be printed as a label, and the user may be prompted for text strings corresponding to title, author, date, volume label, description and so forth. It will be recognized that some devices do not naturally (without connecting to a system with a more sophisticated user interface) lend themselves to keyboard input, such as a portable CD/DVD recorder/player, or camera. In this case the system is configured to receive voice information, which is converted to text with voice recognition. If a display screen is available, the system can display the text prior to it being printed on the disk surface. Otherwise, the disk surface can be printed, and if wrong rewritten.

2.0 eInk—Rocking Knob User Input Device.

2.1 Purpose.

A rocking knob that allows simple one-handed input without the need to move ones finger from one key to another. A rocking button element is retained in the center of an reprogrammable legend field, wherein the input obtained by rocking the switch depends on the context of the system as displayed on the legend field.

By way of example, electronic ink and associated programming electrodes, about the periphery of the knob is changed based on context. It should be appreciated that other forms of reprogrammable legend may be utilized within the present invention without departing from the teachings herein. User rocks the button toward a direction for preselecting (cursor-over function) the displayed action. Selection of the cursor-over function may then be performed by pressing hard enough (rocking it hard) in a that given direction, or pressing down on the button, or by activating a separate button pressed to indicate that the direction is selected. The button may be implemented with a 2 or 3 axis force sensor coupled to the body the button. The electronic ink forms a ring about the button, which may be attached to a fixed or movable surface.

2.2 Incorporated by Reference.

Ser. No. 60/394,160 "KB Lay" pages 281–287

Ser. No. 60/394,160 "eInk Button Legends" pages 77–81 the above being incorporated herein by reference.

2.3 Detailed Embodiments.

Figure 5:
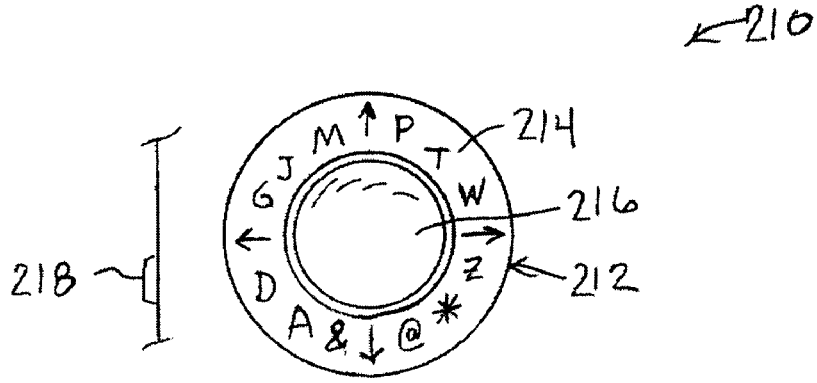
FIG. 5 is a top view of a circular button selector of FIG. 4, showing a second legend context.
Figure 6:
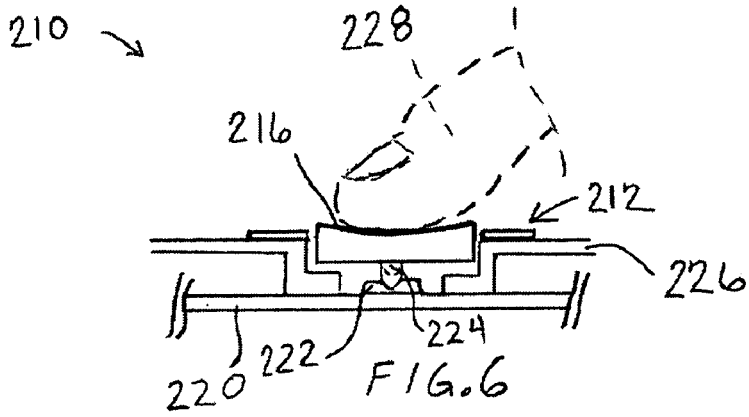
FIG. 6 is a side view of the circular button selector of FIG. 4–5.

FIG. 4 through FIG. 6 depict an interface 210 with a circular button selector 212 upon which legends 214 are displayed, such as using eInks, OLEDs, LCDs, or other displays capable of displaying alternate legends based on context. A central button 216 can be directed toward the peripheral legends for making selections. A separate key 218 is utilized for changing the context of the button legends and thereby button selections. For example, upon pressing context button 218, the number selections from FIG. 4 are changed into the textual input selections of FIG. 5. Numerous levels of context may be provided and these may be optionally customized by the user based on usage or desired use.

FIG. 6 depicts a cross-section view such as implemented within a small electronic device showing a printed circuit board 220 upon which a three axis force sensor 222 (X, Y, Z) is mounted. A stalk 224 extends from sensor 222 connecting to the underside of button 216. The three axis force sensor registers force on the button toward the button legend entries as well as downward force, which for this embodiment is utilized for selecting the number, character, function, or action depicted on the legend to which the button is directed and which has been preferably preselected. A housing 226 is shown surrounding button 216 upon which legend 212 is retained. The interconnections and circuitry of the ring display and force registration devices are not shown for the sake of clarity. It will be appreciated that force registration and the control of display elements is known in the art and described in the patent applications incorporated herein.

The rocking legend button is preferably implemented to provide a preselection indication prior to making the selection. It will be appreciated that a typical key generates a keystroke upon being depressed beyond a given threshold, although no indication (except tactile motion, kinesthetic sense of positioning, and the user view of which key they are pressing) is provided as to which selection is "about to be made". The rocking legend button can be configured with discrete orientations toward which the button may be directed, such as eight, ten, twelve, sixteen, or some other number of discrete "notches" about the periphery which are felt as the user is pointing toward an indicia on the displayed legend. However, this approach limits the number of positions that can be represented and makes it difficult to allow changing the number of selections which are provided in each button context.

Therefore, the present invention is preferably configured to display a legend change indicating what the selection will be prior to the user crossing the selection threshold. The portion of the legend subject to selection (that the user is directing the button toward) is preferably highlighted, such as in reverse video, to alert the user to what the selection will be if they were to complete the selection at this time, which gives the user the chance to modify the direction of they are pressing before actually making the selection. This feature is important on a device providing an analog selection, (as opposed to the discrete nature of individual keys) because the user is more prone to make tactile errors as there is no clear demarcation between selections. It is contemplated that the use of preselection indication on the legends can reduce the possible frequency of button selection errors.

A variant of this feature is described in the keyboard described in the patent application incorporated herein describing a keyboard that may be utilized while lying down. The feature provides a preselection output to allow the user to verify that the selection which is about to be made is correct.

The selection may be engaged in a number of alternative ways. For example, using sufficient force and/or motion on the button in the given direction to cross a threshold thereby making the selection, pressing down on the button to cross a pressure and/or movement threshold, releasing pressure from the button wherein the last preselected action is the basis of selection (allows user to scroll through actions until hitting desired one prior to releasing button), activating a separate control.

Haptic option—As an alternative to preselection indication the present invention may be configured with haptic feedback that directs user input only toward one of the indicias on the button legend. For example an actuator may be coupled to stalk 224 of FIG. 6 so that motion toward areas between the button idicias (i.e. between numbers "2" and "3" on the left of the button) can be discouraged. The haptics generate a reverse or redirecting force opposing the motion being directed toward a location between legends. In this way motion toward only correct values is encouraged, wherein incorrect entry is discouraged. This operates in a manner similar to providing programmable detent notches toward which the button may be directed. Haptic feedback may be provided by coupling any form of positional actuator to a movable button and controlling the actuator in response to movement of the button toward incorrect positions indicated on the legend applying force to redirect the button direction toward a valid selection in the context. By way of example, muscle wire may be connected similar to antenna guy wires from the top of stalk 224 (at least 3 dispersed radially) so that a force can be applied in any direction on stalk 224. It will be appreciated that motors, solenoids, and other forms of actuators may be utilized for generating the desired haptic response to discourage button motion toward invalid intermediate positions, such as those indicated on the reprogrammable legend.

3.0 eInk—Sensing Knobs wherein Indices Respond to Measurement.

Sensing Legend: The legend for the button is displayed based on actual measurements or estimates within which the user is desired to make a selection. For example a frequency dial need not be calibrated as the actual frequency output is measured within the system and the display values are generated and placed based on this measurement and the relative selection.

Figure 7:
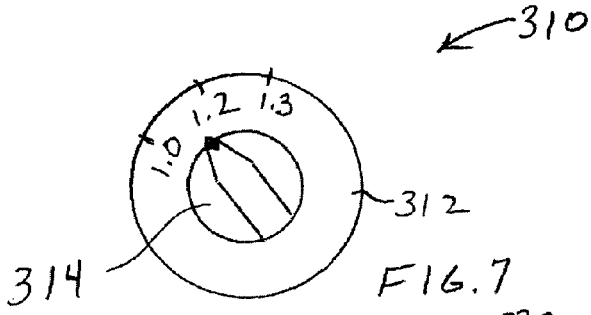
FIG. 7 is a side view of a circular button selector according to an embodiment of the present invention, shown with a programmable legend and movable element.

FIG. 7 depicts a circular knob having a programmable legend 312 and a movable element 314. Legend 312 may be implemented with an electronic ink layer near the surface and configured to be programmed in response to modulating the voltages on upper and lower electrodes, at least one of which is pixelated to allow individual areas to be programmed to a first or second viewing state for writing the legend. Alternatively, the legend can be configured for being written in response to movement of knob 314, such as with one or more rows of electrodes retained over the legend whose voltage is modulated in reference to a background electrode buried beneath the pixels of electronic ink or other voltage programmable material.

The information displayed on the legend (numbers, text, graphics, etc.) in this embodiment is generated in response to actual measurements being taken, which may be optionally extrapolated for filling in portions of the legend that are not at the knob position.

Figure 8:
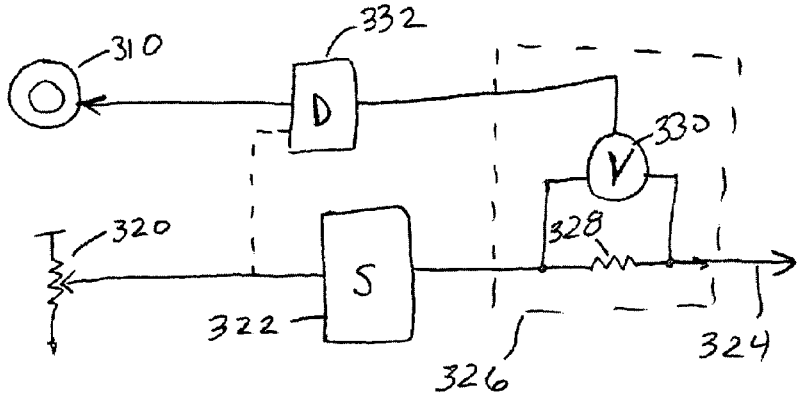
FIG. 8 is a schematic of a measuring circuit in which the selector of FIG. 7 are incorporated according to an aspect of the present invention.

FIG. 8 illustrates a circuit with a user input element, represented by a potentiometer 320, which is connected for controlling an aspect of system 322. An output 324 from system 322 is measured by a circuit 326, herein shown with a shunt resistor 328 across which voltage is measured by voltmeter 330 to determine the amperage passing through output 324. The measured data is fed into legend control electronics 332 which controls the values printed on legend 312 in response to the measurements being taken. The position of the knob itself may also be determined by display control electronics, such as by registering the output value associated with the knob. The measurements in relation to knob motion can be mapped by the display driver, which can extrapolate the data for estimating where the knob would need to be turned to produce any desired reading.

For instance if the current measured is at 1.15 Amps then the legend is printed with 1.15 Amps centered about the current knob position, which is the case shown in FIG. 7. In this way a separate gauge need not be included wherein the user would adjust with the knob while watching the reading.

4.0 eInk—Static Sensing Tags.

To provide low power indications of electrostatic activity, a quasi-conductive (resistive) layer (having a nominal sheet resistance) is coupled over an electronic ink area backed by a ground plane. The electronic ink layer also has a given through resistance to the ground plane so that charges applied at the surface of the resistive layer can reach ground. Any electrical potential (i.e. static) on the individual that contacts the material will result in changing the state of the eInk spheres which provides a non-volatile (static) record the event. The use of resistive layers allows for spreading the voltage over an area of the eInk as it seeks ground, therein increasing the physical area of the "printed" event in relation to the intensity of the event.

Conductive pads, may be placed over the resistive layer to aid in coupling the voltages to the eInk, or to pattern the response as desired. Similarly, the eInk layer or underlying ground plane may be applied in a pattern so that the recorded events are displayed in a desired pattern. For example a unique pattern of dots and radiating lightning symbols, or a grid and so forth.

5.0 eInk—Controlled Non-Static Displays.

To provide displays whose image is automatically erased, fully or partially, after a desired period of time. An embedded erasure display mechanism is utilized over all or a portion of the display area, wherein according to the manufactured characteristics of the distributed erasure mechanism the portions of the display erase after a given amount of time has elapsed after being programmed. The display is configured with a set of electrodes between which the eInk material, or similar, is disposed. A charge of a first polarity applied across the electrodes sets associated electronic ink into a contrasting color from the nominal reset condition.

By way of example, a photoresponsive material is coupled to the electronic ink areas of the display which build charge between the electrodes in a second direction. When the charge builds sufficiently the electronic ink reverts back to the reset color. It will be appreciated that portions of the display may be configured to autoreset, and that the time required to autoreset can be set by the amount of photoresponsive material utilized and charge characteristics as well as the voltage requirements for resetting the eInk.

6.0 eInk—Animated Tag with Static Source.

To provide an animated tag that can operate regardless of ambient light conditions. A radioactive power source, which generates a small sustainable current that extends over a long period of time, is preferably coupled to a storage capacitor and an electronic ink control circuit. Alternatively, small photocells may be utilized for building charge. When the capacitor receives a sufficient charge level the activation circuit is energized, wherein it draws power from the capacitor for reading a new set of states from a memory and activating the opposing sets of electrodes on either side of the electronic ink region to establish the desired pattern of output on the electronic ink. The animated tag may be configured with a circuit to boost the voltage on the capacitor if insufficient voltage levels are obtained to control the electronic ink state. In this way a passive display can be configured to go through a pattern of outputs without requiring a renewable energy source.

7.0 eInk—Labels, Reprinting and so Forth.

The present aspect of the invention allows for the "reprinting" of electronic ink sections that may be otherwise inaccessible. For example for use on a laminated article such as a menu with text and graphics. Then present invention allows the eInk to be rewritten (i.e. to change prices or specials without reprinting the menu).

Figure 9:
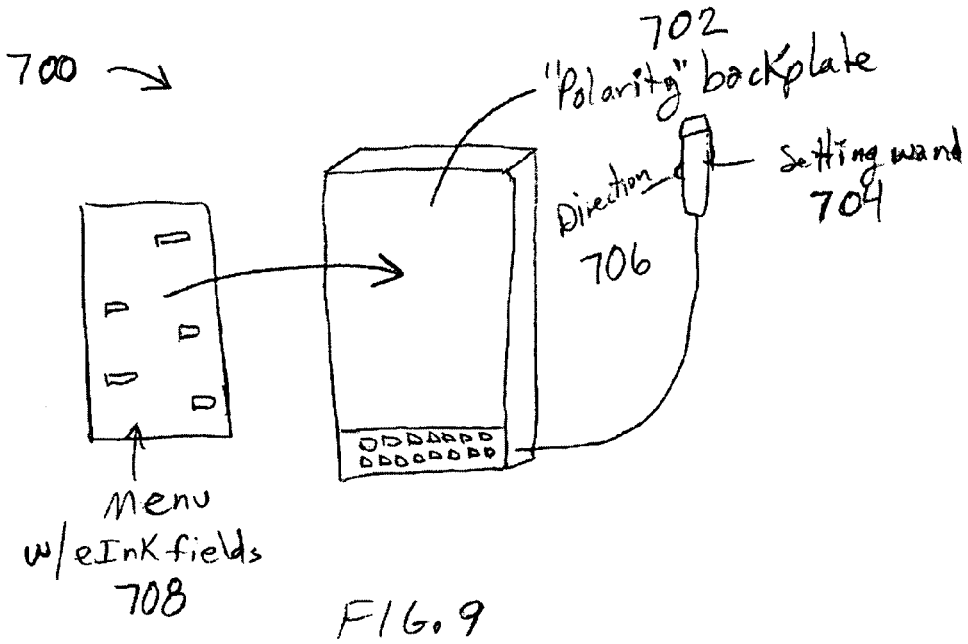
FIG. 9 is a perspective view of a tablet and marking device according to an embodiment of the present invention, shown with an overlay menu card.

FIG. 9 depicts a tablet 700 having a surface 702 that forms a large electrode that operates in combination with a setting wand 704 to alter the eInk portions of the "menu" of other material to a different setting, such as for a price change. The material may be laminated, such as many menus are. The tablet surface 702 generates a first electrical polarity while setting wand 704 with writing control 706 (select state to set eInk when wand passes over eInk) generates the second polarity of sufficient intensity to allow setting or resetting eInk display elements, such on menu. Direction control 706 is shown on setting wand 704 to select the relative polarities of the setting wand and the tablet.

The wand may be set of cover a wide area for resetting and to provide a smaller setting nib so that it may be used for writing over the eInk to set a new value.

Alternatively the setting wand may be programmed to generate one or more rows of electrode settings as it is scanned over an eInk material, as described in the included application.

Figure 10:
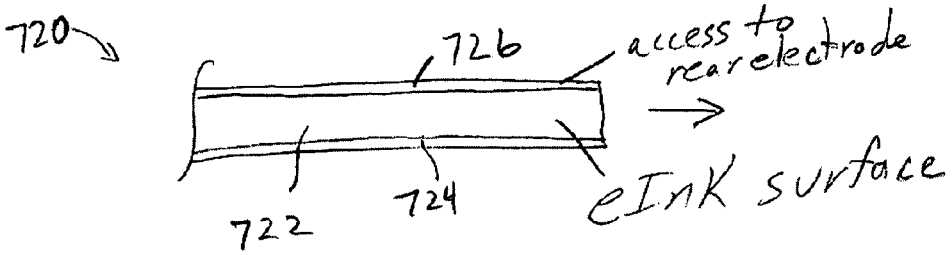
FIG. 10 is a facing view of an electronic ink label strip according to an aspect of the present invention.

FIG. 10 illustrates an example of an electronic ink label strip 720 which may be printed after being attached to an article, or alternatively, either before or after attachment. The label comprises a color plane 722 of any desired color, a first conductive (generally transparent) plane as a backing, a layer of electronic ink spheres within a clear polymer matrix. Access to the background electrode is provided during manufacture, such as by not overlaying the edges 724, 726 of the label with electronic ink or insulating materials. Alternatively when the label is cut, or first written to, a portion of the materials on the front may be removed so that access is provided to the rear electrode.

Although a front electrode can be provided, it is not necessary, as is the case in other described embodiments, so long as the rear electrode may be biased during writing to an intermediate voltage between a first state programming voltage and an opposite polarity (in relation to the intermediate voltage) second state programming voltage. The electrode on the writing head then are set to either the first or second programming voltage wherein the entire label is "Written" to such that prior content is erased.

Figure 11:
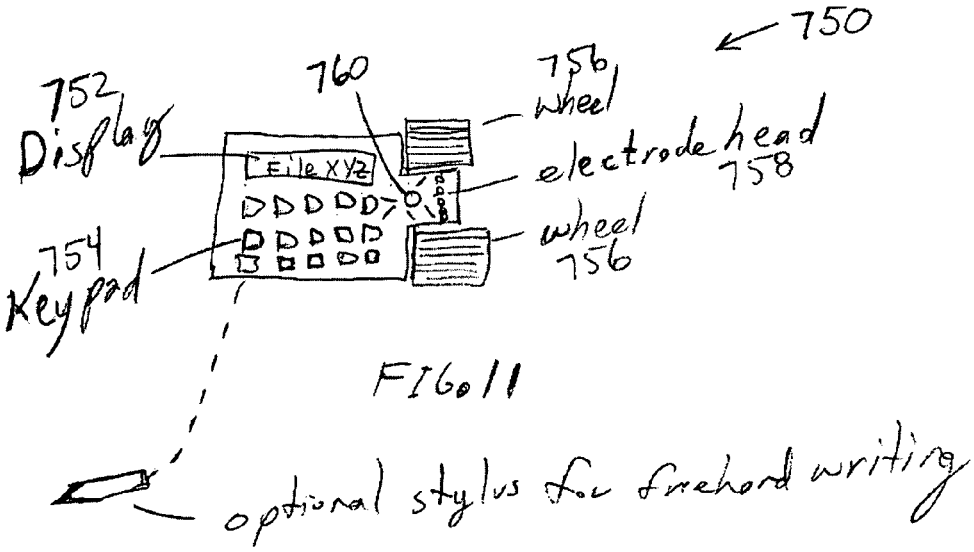
FIG. 11 is a top view of an electronic ink label marker according to an embodiment of the present invention, shown for use with the label strip of FIG. 10.

FIG. 11 illustrate a labeling device 750 configured for use with the label of FIG. 10, or other forms of electronic ink labels. The edges of the label 724, 726 of FIG. 10 are shown with the edges configured to yield a conductive surface for connecting to the underlying electrode. For example the rear electrode may be raised, electronic ink layer not placed over the rear electrode, and so forth.

A user is provided with a generally conventional display 752 and keypad 754 for selecting what is to be written. (The display may be preferably configured as an electronic ink display. Furthermore, it may be appreciated that since the user can reprogram the display, the need for previewing the elements to be written is not absolutely necessary. Contacters 756 configured for engaging the edges of the label area of FIG. 10 are shown in the form of wheels on either side of an electrode head. The wheels are configured to make contact with the underlying electrode of the label while an electrode head 758 provides the +/−programming voltage to set the state of the eInk elements being written. The wheels also provide for registering the speed of motion across the label area which is used by the electronic controller within the unit for controlling the rate at which the pixels are clocked out to the electrode head.

It will be appreciated that the rear electrodes of the material may be brought out in select areas to allow the wheels to make rear electrode contact, for example strips along a multiline label.

Alternatively, the label may be created without direct access to the rear electrode, wherein the writing device may be created with a mechanism for penetrating front, (non-conductive) layers to access the rear electrode, such as sharp a single sharp probe, or miniature spikes extending from wheels on the programming unit, which pierce the thin upper surface and contact the rear contact during writing. Use of the microspikes on the wheels allows single lines on larger label sheets to be written. The use could then cut whatever portion of the sheet was desired and program it before or after cutting in multiple passes of the writer unit.

It is preferable that an indication 760 be provided on the unit that the wheels are making contact with the rear electrode, for example, a green LED that activates in response to a proper conduction path established between the two wheels. (LED should show red otherwise). Other forms of audio and visual indicators may be equivalently utilized without departing from the present invention.

If large areas are to be erased a large electrode surface can be provided such as on the back of the unit wherein the user upon selection reset can roll the unit with the back, or portion thereof, against the eInk material to erase a large area.

8.0 eInk—Adding eInk Control Capability to a Printer.

The present system is configured to allow a paper feed type printer to perform conventional printing in addition to setting eInk to a desired state thereby writing text and graphics to it which may be overwritten at any time.

The print head of a conventional printer may be augmented with a row of electrodes that, in combination with an opposing background electrode, such as a roller wheel held at a given electrical potential, allow for "printing" the correct setting of eInk along the material. Alternatively, a separate head may installed on the printer carriage (i.e. of an ink-jet style printer) to allow printing to electronic ink. Alternatively, the printer cartridge may be replaced with a module that controls the setting of the electronic ink. Alternatively, and less preferably, the printer may be configured for printing in electronic ink only.

Figure 12:
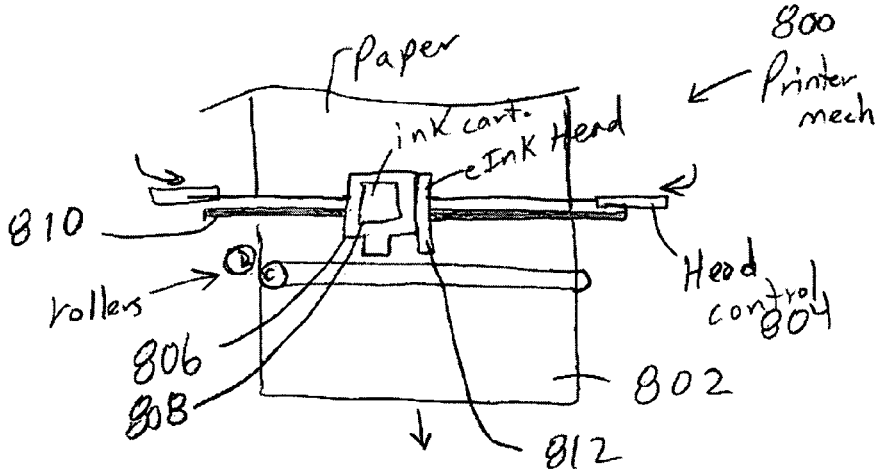
FIG. 12 is a top view of an electronic ink marking head incorporated within a printer according to an aspect of the present invention.

FIG. 12 shows a printer mechanism 800 through which paper 802 is being fed. A head control 804 controls the movement of the print head 806 with ink jet cartridge 808 along a slider rod 810. Conventionally, the ink is output from the cartridge in a vertical row of overlapping dots that in combination with the scanning of the head allow the entire surface of the paper to be selectively inked.

A separate eInk module 812 is shown adjacent the ink cartridge so that electric ink embedded in all, or portions, of the paper may be selectively set (written on) using an electric field across the paper of the desired polarity to set the eInk to a first or alternatively a second state. The eInk module contains a vertical row of electrodes while a conductive region, or conductive roller, retained beneath the paper material is held at an opposing electric potential. The electric field between the active elements within the eInk head and the conductive area causes the eInk spheres to be set to the desired orientation.

Typically ink would not be printed over regions that the user wants to print using the electronic ink head, unless a light color, or transparent color, is applied wherein the changes to the electronic ink may still be readily seen on the output.

9.0 eInk—Paper and Printer Mechanisms.

The present aspect of the invention provides enhancements which facilitate printing on electronic ink embedded papers.

9.1 Paper.

Paper configured with electronic ink spheres, or similarly electrically programmable material, is configured in this aspect with a means for indicating that the paper contains electronic ink. Optionally the paper may include positional references spanning portions of the paper which may be detected for controlling the activating of the printing electrodes as the paper is moved during printing.

By way of example, the means for indicating that the paper includes electronic ink may comprise an indicia on a surface of the paper for being read by the printing device during printing. For instance a yellow icon may appear in corners of the sheet for detection upon insertion into a printer. It will be appreciated that these indicias may comprise conventionally printed elements in a desired color, such as yellow which does not show up on copies, or in ultraviolet responsive colors.

The paper, or other material to be printed, may contain electronic ink on a first surface, or on a first and second surface. The means for indicating that the paper contains electronic ink is preferably configured to indicate which side of the paper contains the electronic ink, or if both sides contain the electronic ink. For example a different indicia may be used for indicating that the sheet contains electronic ink, and that this particular side contains electronic ink.

UV striations on the edges of the paper allow the travel in either portrait of landscape mode to be tracked. Alternatively, a grid of UV responsive (reflective, or absorptive) material may be printed over the sheet so that tracking of speed and location may be determined across the grain of the paper.

The spacing of the grid, or other aspects of the marking, can be utilized to indicate the density with which the electronic ink has been applied to the paper, thereby allowing the printing device to select or otherwise indicate the resolution that may be printed on the paper.

9.2 Printing Device.

The printing device according to the present aspect of the invention is configured with sensors for registering that the paper contains electronic ink, or contains a standardize indicia indicative of electronic ink. It will be appreciated that conventional printers may be configured with an electronic ink printing head or that other items may be configured with a printing head to allow printing on a sheet of paper (or other material) containing electronic ink that is passed through the device. The printer according to this aspect of the invention can automatically sense that the paper is an electronic ink sheet and print using the electronic ink voltage outputs, and not using a permanent ink, when the insertion of a sheet with electronic ink has been detected.

To provide faster printing on electronic ink, the printing device preferably comprises at least a first and second electrode head which are directed at opposing faces of the electronic ink material. These electrodes are preferably spaced apart to prevent interference from one another along the path of the material.

10.0 eInk—Button Legends.

It is often difficult to create low cost multistate buttons which indicate the state of an element or an action that is to occur based on the pressing the button. For example a button that selects between a first and second setting of valve may be marked "Close Valve" and "Open Valve". Optionally additional states may exist such as "Valve at 25%", "Valve at 50%", and so forth. It will be appreciated that a button used to select from a number of choices could have a legend that changes to indicate current or next available setting. The button may represent a number of actions for the button.

The eInk button legends of the present invention can provide one or more display outputs in response to being pressed by a user. The button legend may be set with one or more fixed patterns or may be created on as a graphic on the face of the button in response to information received from a control element within the system.

In one aspect of the invention, the power for changing the state of the eInk display is preferably only available while the button is being pressed, in this way the power requirements are reduced automatically and there is no need of sophisticated control electronics when only a few preprogrammed states exist.

In another aspect of the invention the button alters the setting of a flip-flop or a counter, the output if which is available for controlling external circuits and for changing the state of the eInk display. For example a counter having four outputs states and lines, can turn four elements on and off. Each outline line may be coupled to the display in a DC mode (i.e. through a resistor) to set display state based on applying a charge across a preformed grid, such as a mask with a graphic on it, and an opposing voltage plate on the opposite side of the eInk. The outputs may in many cases be AC coupled to the eInk display using capacitors due to the need for power only when changing the state of the eInk display element.

Preferably a grid of elements or a vertical series of conductive electrode masks are contained beneath the electronic ink and a fixed conductive (transparent) grid is retained over the top of the electronic ink. Selecting all the masks with one polarity and the opposing (facing) grid with the other in a first polarity allows resetting the legend, while applying a second polarity to any one mask and the opposing grid allows for displaying that mask on the eInk.

A grid may also be formed by cutting a through conductive surface and dividing it into two or more sections. The surface can be divided using a laser, water stream etching, particle etching, chemical etching, mechanical material removal, and so forth. The electronic ink may then be deposited over the sections and a full span substantially transparent conductor over the top. The divided sections of the lower conductor can be activated in unison in a first polarity, relative to the surface conductor, to reset the electronic ink to either its first state or second state. One or more of the sections may then be individually set to a second polarity in relation to the surface conductor so as to create an image on the electronic ink which may be seen through the surface conductor. It will be appreciated that image areas may be displayed in either conventional or inverse video mode at depending on the polarities utilized.

Figure 13:
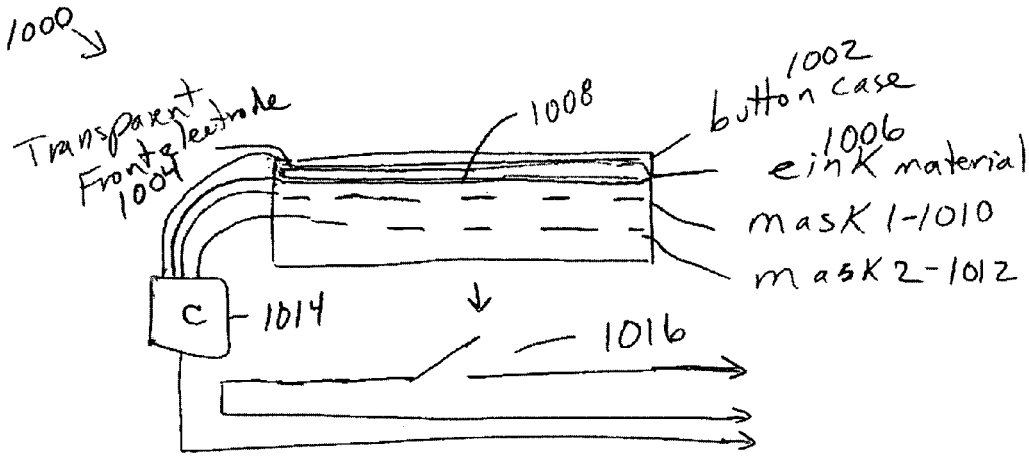
FIG. 13 is a cross-section view of an electronic ink button legend according to an aspect of the present invention.

FIG. 13 depicts an electronic ink legend button 1000 having a button case 1002 that seals and protects the button electronics. A transparent, or semitransparent electrode 1004 forms the front surface of the button over a section of electronic ink 1006 underneath which is preferably retained over a second transparent electrode 1008, and one or more electrode masks 1010, 1012 (shown with 2 electrode masks). The masks may comprise physical material that is conductive, however, it preferably comprises conductive material that is printed on the back of the button in a substantially transparent pattern, wherein upon activation at a polarity opposing the top surface the eInk therebetween will be set to match the mask shape. It will be appreciated that the eInk may be reset to a given state ON or OFF, by establishing a given polarity between the upper and lower surfaces of the electronic ink. The electrode layers are shown connecting to a controller 1014 that is passed data in response to the desired setting of the button, such by a computerized system that is being controlled by the use of the button. Pressing down on the button legend is shown activating a simple switch 1016, however, it will be appreciated that a multi-state selector, or other form of input device may be equivalently implemented.

11.0 eInk—Text/Graphic Display.

The present aspect of the invention allows the creation of inexpensive displays that are capable of displaying text, graphics, along with activation/deactivation of preformed legends.

It will be appreciated that polymeric circuits are now being developed by a number of processes, some that allow the circuit layers to be deposited using conventional printing processes, including even simple ink jet printing. Polymeric circuits have some significant advantages in that they are very inexpensive and can be fabricated in any desired sheet size. The present invention melds a polymeric material containing electronic ink spheres to the polymeric circuit.

A polymeric circuit is fabricated, or printed, with a desired display control function, voltage outputs for regions of the display are provided as surface electrodes on polymeric circuit, while a complementary voltage output is provided as one or more additional electrodes. It is preferred that the regions of the electrodes comprise areas that cover the entire surface of the display area where the electronic ink is to be deposited, with only very small gaps therebetween. This allows a single backing electrode plane to be used with a single front electrode plane.

To prevent unused areas of electronic ink over the polymeric material from being retained at arbitrary states, the front electrode may be biased to a center voltage between a power and ground voltage, which may then be used for controlling the state of the sections of electronic ink.

The "unused areas" of the display may be utilized for recording what is written with an electrode tipped stylus as described elsewhere. In this case the unused areas should be retained at a voltage close to that of the facing electrode, wherein stylus voltage can be at a voltage below that of the facing electrode (at least by an amount equal to the threshold of the electronic ink spheres at the given distance). This aspect of the invention allows integrating a display and a writing surface.

A layer of electronic ink spheres embedded in an additional polymeric layer is deposited over the polymeric circuits that have surface electrodes of a shape for controlling areas of the electronic ink. An electrode layer is then deposited over the electronic ink and connected to a common electrode output for the polymeric circuit. It will be appreciated that a number of circuit types may be embedded within the polymeric circuit to create various effects within the electronic ink layer. By way of example and not of limitation these comprise: decoder/driver circuits for graphics and/or textual display, sequencing circuits, strings of D-Flip-flop chains for serial loading of data for a string of eInk pixels, animation timing circuits, logic arrays, clock timers, calculators, and so forth.

Electronic circuit elements, generally simple circuits, are created in layers on polymeric sheet attaching to large conductive electrode pads. Electronic ink material is applied over the conductive electrode pads which form the first electrode. A conductive material is applied in a grid or thin layer over the electronic ink so that the electronic ink may still be seen, this layer forms a second electrode. Electric fields applied across the electrode pairs control the eInk in between. The second electrode may be attached to the underlying circuit elements on the periphery of the circuit or through the electronic ink. By way of example, sections of electronic ink may be left open, or removed after application, wherein the second electrode layer is deposited so as to attach at selected locations to the electrode pads on the polymeric circuit beneath.

Figure 14:
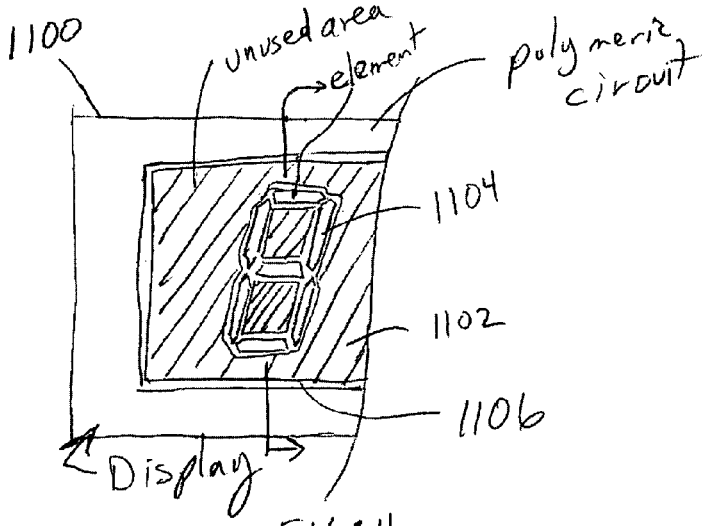
FIG. 14 is a top view of a polymeric electronic ink display according to an aspect of the present invention.

FIG. 14 depicts a top view of a polymeric circuit sheet 1100 having an electronic ink display region 1102 integrated over the top, a single 7 segment digit is shown, however, the technique is applicable to displays having any desired number of display elements, such as text displays of various segments per character, graphical displays, iconic displays, and combinations thereof.

The polymeric circuit is shown as the large portion 1100 in FIG. 14 with an area of electronic ink spheres 1102 embedded within a layer of clear polymeric material overlaying an electrode grid 1104 connected to the polymeric circuits which is shown having a boundary or contact region 1106 between a transparent overlying electrode and the underlying polymeric circuit.

Figure 15:
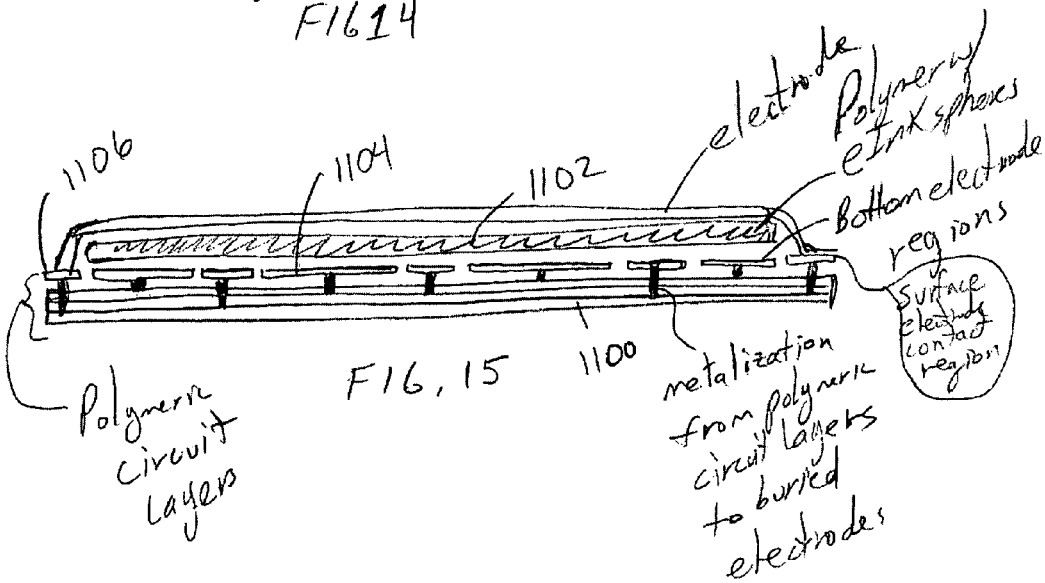
FIG. 15 is cross-section view of the polymeric display of FIG. 14.

These layers are more easily seen in the cross-section view of FIG. 15. It will be appreciated that the polymeric circuit need only supply a voltage (over the setting threshold for the ink spheres at the given spacing) between the electrodes corresponding to the elements and the electrode overlapping the entire display. The segments may be cleared by setting their voltage opposite the programming voltage in relation to the top electrode. It is therefore preferably that the top electrode be driven at a bias potential, such as between the power and ground voltage and separated by each by a voltage that equals or exceeds the threshold voltage for controlling the eInk spheres. In this arrangement the display element electrodes are driven close to either power and ground to change the states of the eInk spheres between the element electrode and the electrode on the upper surface.

This method of construction allows for the manufacture of very inexpensive displays that can perform a variety of functions, such as counting, timing, animations, and so forth.

12.0 eInk—Daylight Enhanced Indicators.

The present inventive aspect provides for increasing the visibility of lighted indicators/displays in high ambient lighting environments. Lighted displays provide reasonable visibility under most circumstances, however, in high ambient lighting conditions that can be difficult or impossible to see. The alternative today is to provide a separate displays for day and night use, or use a backlite display with a super high contrast ratio.

The present inventive aspect allows for increasing the visibility of a lighted display by overlaying the lens of the element with a sparse array of electronic ink which may be controlled from the same voltages used for driving the indicator.

One example application for this technique is with automotive signal lights, such as turn signals, brake signals, reverse light signals. These indicator lights can become "washed out" when light from ones headlights, or the sun, is reflected from the lens over the light. The ambient light reflecting from the lens can be as bright as the light being emitted through the lens, wherein the problem lies.

The present invention overlays, or embeds, a set of transparent electrodes between which is located a sparse distribution of electronic ink spheres. Preferably the spheres are collected into small clusters with substantial transparent spacing between each cluster.

Figure 16:
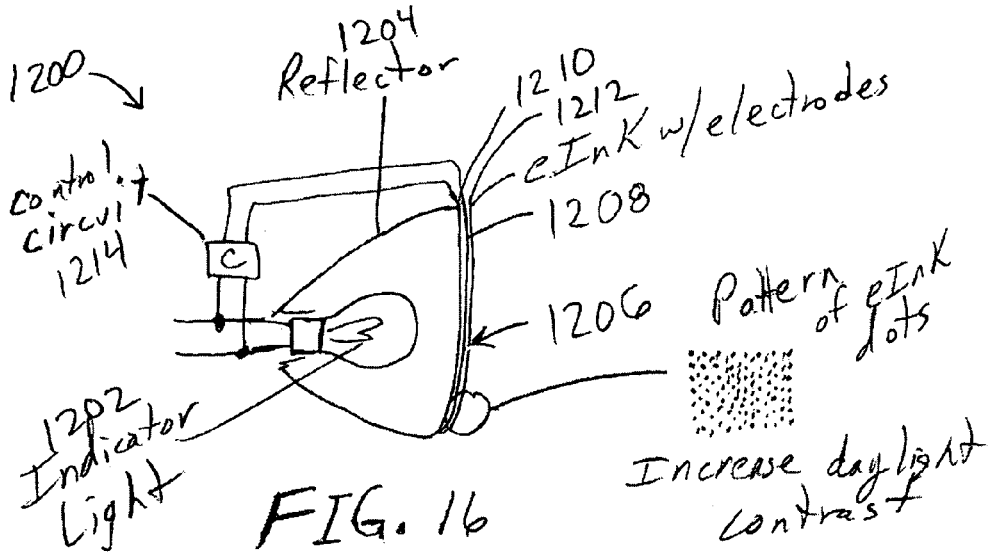
FIG. 16 is side view of a daylight-enhanced indicator according to an embodiment of the present invention.

FIG. 16 exemplifies a lighted indicator 1200, such as a turn signal, having an indicator light 1202, or lights, within a reflector assembly 1204 which directs the light out through a lens 1206. Electronic ink spheres 1208 (or similar voltage programmable material) are sandwiched between transparent electrodes 1210, 1212 on the interior or exterior of the lens, or integrated within the material of the lens. A first grid of substantially transparent electrode may be deposited (or printed) on the lens, such as in a pattern similar to that of horizontally and vertically ruled graph paper. The electronic ink is then deposited on the electrode grid pattern, such as clusters over the nodes of the grid pattern. A transparent filler material may be deposited beneath, or with, the electronic ink layer to smooth the surface. A second grid of electrode is then deposited (or printed) over the electronic ink. Connections from each electrode is then brought out to the controller 1214 for setting the state of the eInk with respect to the state of the indicator.

The sparse array of electronic ink clusters of this invention, or other form of sparse array, is then driven to a first state when the indicator light is active and a second state when the indicator light is inactive. The material utilized within the spheres of electronic ink are selected so that in high ambient conditions to increase the discernment of an active indicator light from an inactive one. For example when the indicator light is active the electronic ink can be set so that a highly reflective ink is directed toward the exterior of the lens, so that ambient light will be reflected to increase the intensity of the light seen by the observer (light from the indicator light+high ambient light reflected from the lens). When the indicator light is inactive the electronic ink should be in a non-reflective state wherein ambient light is absorbed and the lens appears to darken.

Preferably, to increase the recognition of the active state, the electronic ink should be oscillated on an off at a rate between about 2 Hz and 20 Hz, wherein the "flicker" of the light reflections under high ambient conditions are easily registered. Further the intensity of the indicator light should be modulated accordingly, preferably at the higher end of the range. Modulating the intensity of an active indicator light at high, but perceptible speed, provides benefits to all indicator lights subject to be washed out by ambient lighting, and may be implemented as an aspect of the present invention separately from the use of the electronic ink sparse array.

The electronic ink may be controlled by sectioned electrode grids that allow modulating parts of the surface area, wherein shimmer patterns and other eye catching patterns can aid recognition of the condition being indicated.

The present invention may also be configured to flicker the reflected light by sequentially selecting different areas to be in different eInk states. For example with rows of interleaved electronic ink sparse arrays, a first set of rows is activated when the indicator light is activated, then after a predetermined time, a second set of rows is activated while the first set of rows is deactivated, after which the first set is activated again and the second set deactivated, and so forth. When the indicator light power is off, then the eInk would be preferably in the off state. (Although power from the capacitor could be used to reverse the directions of activation and deactivation as desired.) This may be extended by using various patterns to any depth of modulation desired. Furthermore, pattern of eInk activations may be controlled by timing circuits, sequential control circuits, microprocessors, and the like.

Figure 17:
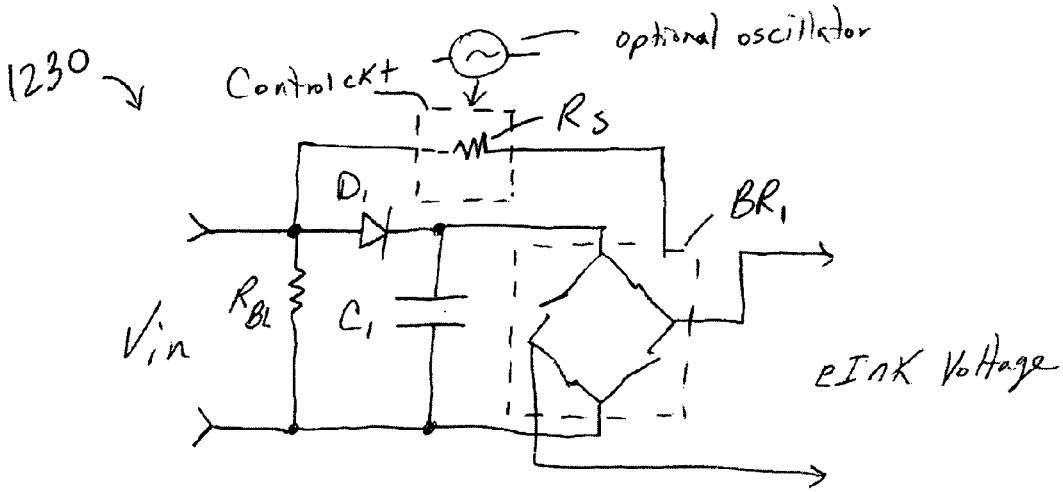
FIG. 17 is a schematic of a first circuit for driving the state of an electronic ink display according to an aspect of the present invention.

FIG. 17 depicts a circuit 1230 for driving the electrodes on either side of the sparse array of electronic ink. The input voltage $V_{in}$ is directed through a diode $D_1$ to charge a capacitor $C_1$. When power is removed then Vin drops by virtue of $R_{bl}$ and the intrinsic load on the output voltage. The voltage from the capacitor is directed to a switching circuit, in this case a bridge circuit that preferably utilizes FETs for directing the output voltage. A control circuit directs the switching of the switching circuit to modulate the state of the electronic ink within the sparse array. The control circuit may be simple be a connection to the input voltage $V_{in}$, (preferably through a resistor) wherein the swing of Vin causes the switching circuit to switch states. It will be appreciated that when Vin is supplying power that the voltage of $[V_{in}-V_{diode}-2(V_{switch})]$ is seen at the output of the switch circuit. When $V_{in}$ drops to zero, the voltage of the capacitor provides power through a reversed switch circuit to drive the eInk elements to the opposing state. The control circuit may comprise an oscillator that when $V_{in}$ is providing power it causes the electronic ink to vacillate rapidly between two states, while when $V_{in}$ is inactive, the eInk remains at a single state.

It should be appreciated that the bridge circuit is only one of the types of switching circuits that may be utilized for the present invention. Any circuit that can reverse the voltage on its output lines can be used, such as capacitor switching circuits, voltage doubler type circuits and the like.

Figure 18:
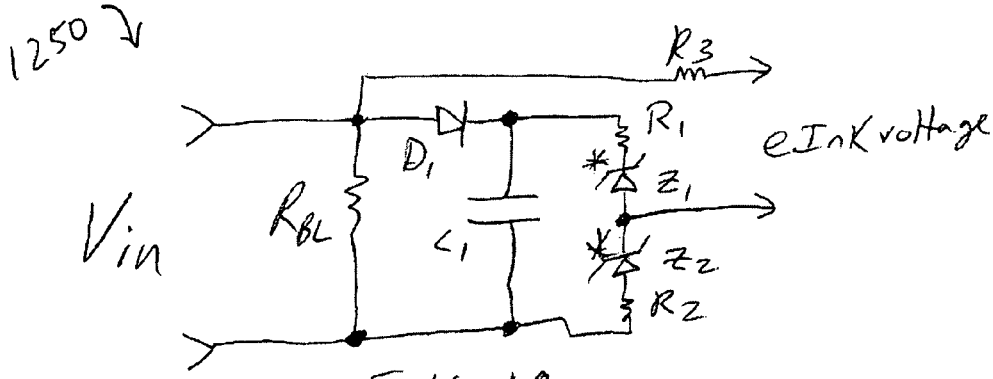
FIG. 18 is a schematic of a second circuit for driving the state of an electronic ink display according to an aspect of the present invention.

FIG. 18 illustrates another form of simple circuit 1250 that may be utilized for modulating the state of the electronic ink sparse array, wherein a bias voltage is created to drive a first electrode of the display while a second electrode is provided by the input voltage itself which when active drives the eInk to a first state, and when not active drives it to a second state. Obviously the swing of $V_{in}$ must be more than double the voltage intensity required for setting the state of the eInk in a given direction. Furthermore, it should be appreciated that the zener diodes may be left out of the circuit wherein the resistors provide a divider between which the bias voltage is generated. Very little capacitance is required of $C_1$ because the eInk need only be triggered into a new state and does not need any power for maintaining a state. The size of $C_1$ is primarily determined by the rate at which $V_{in}$ drops, in some systems is may be beneficial to use a voltage regulator instead of the diode, wherein a sharp drop of voltage supplied to the capacitor occurs when $V_{in}$ drops below the regulation threshold.

Aspects of the present invention include the method of increasing daylight recognition of a lighted indicator/display element, the construction of an indicator light, the circuit for controlling the electronic ink.

A method of increasing the recognition of lighted displays/indicators subject to high ambient lighting conditions as described herein.

13.0 eInk—Voltage Sensing.

The present aspect of the invention provides a low cost voltage (current) graphical indicator. An embodiment of the invention may be fabricated by applying electronic ink layered between two electrodes, wherein the spacing between electrodes increases over the span of electronic ink wherein the electromotive potential to which the eInk is subjected is reduced as the spacing between electrodes increases. If the voltage indication is to be erased, then a sufficiently high voltage may be applied in the reverse direction, or additional electrodes may be utilized without the extra spacing to assure that the eInk is erased at a low potential.

Varying the spacing between electrodes may be accomplished by adding a tapering spacing layer between the electrodes or by building up the electrode toward one side of the display. A number of techniques are available for increasing the effective spacing between the electrodes so that the voltage threshold (from one electrode to the other) for setting the electronic ink varies along the length of the section of electronic ink. The space may comprise a section of non-conductive material, such as plastics, or elastomers, that are fabricated in a wedge shape, or following a mathematical profile associated with the voltage profile desired.

Figure 19:
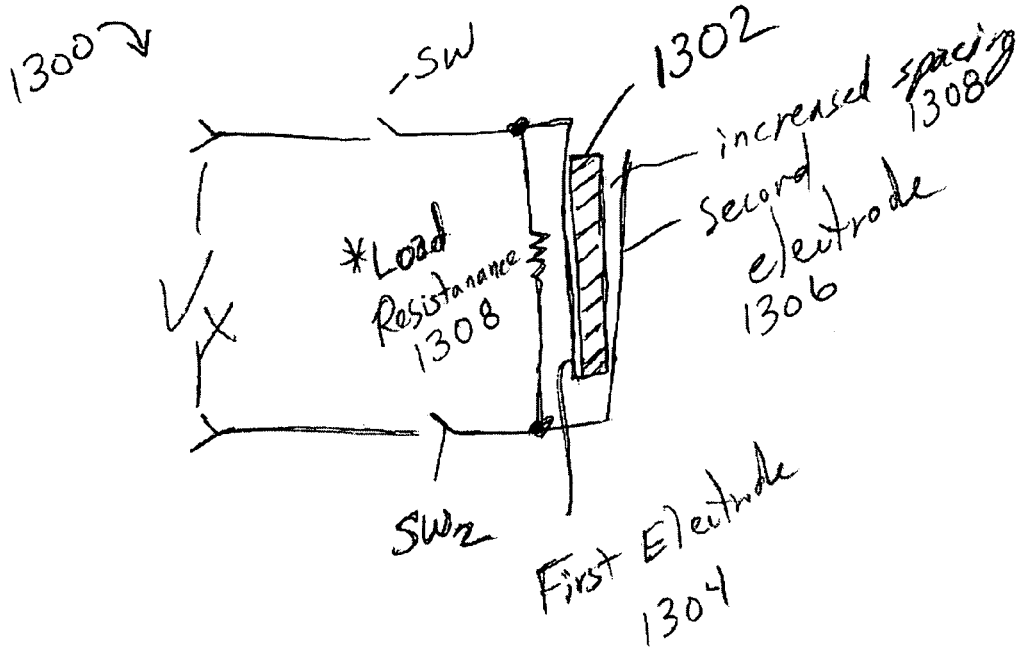
FIG. 19 is a low-cost graphical indicator according to an embodiment of the present invention.

FIG. 19 depicts a voltage sensitive display 1300 having a thickness of electronic ink 1302 sandwiched between two non-parallel electrode planes 1304, 1306. An optional load resistance 1308 is shown so that the indicator registers the output voltage $V_x$ under load.

The electronic ink itself may be deposited in stripes or bands of alternating color electronic ink, wherein a scale is displayed as the electronic ink is activated in response to a given voltage. The voltage display may be backlite by embedding the electronic ink spheres in a transparent, or semi-transparent, material behind which a light source is disposed. The light can traverse through the transparent portions of the display while the electronic ink may still be seen.

An additional, or alternative means of making the display voltage sensitive, is by altering the voltage response characteristics of electronic ink sphere, such as the composition of materials used to fill the ink spheres, the size of the spheres, the material of the spheres, the internal roughness of the spheres and so forth.

Another method of providing a voltage indicating section of electronic ink is to deposit sections of electronic ink which respond to sequentially higher, or lower, voltage thresholds across the span of the indicator. This technique also be used in combination with the wedged electrode spacing to facilitate the creating of any desired voltage versus. eInk display activity transfer function. If a logarithmic, or pseudo logarithmic scale is to be used the wedge spacing may be created as a series of steps with a different formation of eInk being deposited on each step. Furthermore, a series of electrode segments may be deposited that are each connected with a different value of resistance, so that each segment registers a different relative potential in response to a given voltage.

The electrode itself may be resistive, wherein the voltage at any location along the electrode is determined by the voltage drop across the given resistance.

Figure 20:
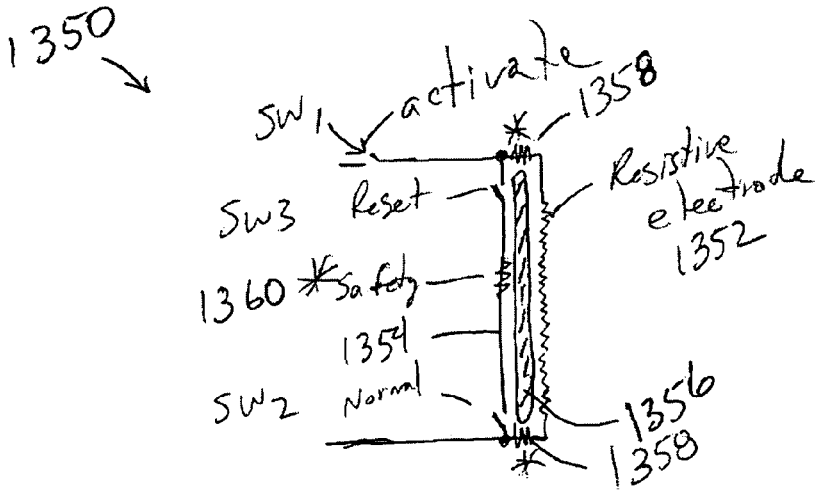
FIG. 20 is a schematic of an electronic ink voltage display based on FIG. 19.

FIG. 20 depicts a simple circuit 1350 utilizing this mechanism for providing an electronic ink voltage display. The resistive element forms a first electrode 1352, a second electrode 1354 may be either connected to power or to ground depending on whether the display is being written in a first direction or a second direction. The eInk is shown sandwiched between the first and second electrodes. Optional resistive elements 1358 (may be part of same electrode just not associated with portions of eInk) are shown on either end of the resistive element for biasing the resistive electrode to allow more proper resetting. A safety resistance 1360 is shown between the two switches $SW_2$ and $SW_3$ to control current draw should both switches be inadvertently engaged. It will be appreciated that resistance may be controlled by conventional methods, such as the use of conductor paths with low conductivity, for instance Nichrome; while the cross-sectional conductive area may be modulated in layer thickness and/or width. In addition the material may be layed down over alternating materials of lesser conductance, wherein a trace vacillates between conductive lines and less conductive lines, with the mix being modulated according to the average resistance desired for a particular section of the trace.

To provide voltage variation along an electrode an electrode with a set resistive profile is created for one or both opposing electrodes, the electrode is used as a current path wherein the voltage drops along the electrode path. Electronic ink disposed between the electrodes is then responsive to the amount of current (or voltage across the electrodes) depending on position along the electrode, wherein a graphical output is presented.

The electronic ink voltage (current) displays may be utilized in many different applications, including flexible battery testers, such as are attached to the sides of primary batteries for testing their condition. The electronic ink may be configured as a display that when the contacts are pressed indicates a reading along a scale, as already described, wherein the reading may be automatically reset, reset manually, or retained. If the "bar graph" reading is retained it can be compared with the next reading performed. Subsequent readings can be set for opposing directions on the voltage scale, by using different switches wherein opposite readings are of opposite polarity, and thereby act as their own reset. Furthermore, due to the inexpensive nature of the electronic ink voltage scale and membrane switches a series of voltage scales and switches can be provided if one wanted to track the changes in battery capacity over time.

Any applications that require a graphical output, wherein the amount of the display that is set to a particular color is responsive to changes an input voltage or current flow may utilize the present electronic ink display. It should be noted that the graphical output need not be in the form of a bar, as it may form an arc, concentric circles, curving lines of any desired pattern, and so forth.

Two sets of electronic ink colors and grids may be utilized, wherein a two dimensional graph is shown of two different voltages or currents. A common rear electrode may be utilized, over which a patterned placement of two electronic inks is layered on the electrode, over which a first electrode grid is placed to control the first deposited elements of electronic ink, and a second electrode grid placed to control the second deposited elements of electronic ink. For example the first and second grids may be positioned at right angles to provide a two dimensional display, such as square or rectangular, that simultaneously displays two variables, one example would be for an audio system display that simultaneously indicates right to left balance and front to back fade using two colors of electronic ink and a different off-state color (both variables may be indicated with a single background color, such as white, or with different background colors which blend to a desired color that then shifts according to the changes in each of the variables. One electrode grid running in a first direction and Using two colors of electronic ink in an array pattern For example vehicle status indicators (e.g. battery voltage, charge current, and so forth), indicators for use within instrumentation, and in any situation wherein a graphical output is desired.

Taking it further it will be appreciated that additional electronic ink patterned dots with associated electrode grids may be created for graphically indicating additional variables. For example a surface may be configured to change colors according to one or more variable voltages (currents). It will be noted that electrode patterns may be created on a surface in a number of ways including, traditional circuit fab steps, deposition, sputting, and so forth, and non traditional ways which are available for large geometries, such as screen printing, painting processes and so forth.

14.0 eInk—Use with w/Integrated Electronics.

The present inventive aspects provide for increasing the effectiveness of posters and similar learning and printed entertainment, such as described in U.S. Pat. No. 6,241,527 issued Jun. 5, 2001 by the same inventor, which is incorporated herein by reference. The described "matching game" poster device may utilize electronic ink, and polymeric circuit technologies as described to provide additional functionality and/or lower costs. It should be appreciated that the "matching game" is but an example application wherein numerous applications exist to which these features may be applied. The following objects may be obtained:

Print a photoresponsive material as a power source.

Incorporate electronic ink sections to:

- render block animations of characters, graphics elements, etc.,
- display time, and/or date,
- display a perpetual calendar that may be written on,
- provide a note section that may be written with electrode stylus,
- change colors, inverse video,
- Matching game related:
- highlight allowable selection button
- output a visual as alternative/addition to audio
- Incorporate circuits printed onto material with polymeric circuits to:
  - Provide 8M8 functionality
  - Retain data, i.e. textual, or audio information for the poster
  - track time and date
- register touch inputs Display text on an eInk section having row/column traces in response to user touching a selected screen element. (audio sounds, voice, etc can be provided instead or to accompany the displayed text).

15.0 eInk—Light Responsive Display (LRD) and Other Enhancements.

The present inventive aspects provide for writing to a display in response to the light which impinges on the surface of that display.

It is often costly to provide for the programming of a display, for example row and column drives may be required along with a user interface upon which information may be entered for the display. The advent of very low power electronic ink displays now allows displays to be created that can be controlled using very little power and which can be retained in a static mode without power consumption.

The present invention provides for the programming of a static display in response to the receipt of light impinging on the surface of the display. A layer of photoresponsive film is bonded, or layered over the surface of an electronic ink display. The electronic ink display preferably having electrode grids spread over the front and back of the device to facilitate full panel resetting, and optionally configured in an X-Y grid to also allow for electronic programming of the display or elements therein. When set in program mode in which the front layer is left in an unbiased state and the rear of the display is biased to oppose the voltage of the photoresponsive material, then the eInk spheres can be programmed to a given state in response to the receipt of sufficient photons on the surface. The bias voltage for the opposing electrode may be derived from the voltage from the same section of photoresponsive material, or another area containing photoresponsive material having a lower output voltage, such as pulled toward ground, or otherwise constructed to generate a lower voltage. It will be appreciated that a number of materials exist for generating electrical fields in response to the receipt of light. For example, Heterolamellar photoelectrochemical films, such as described in U.S. Pat. No. 5,695,890 to Thompson et al. issued Dec. 9, 1997. If the photoresponsive material is opaque then it should be deposited over the display in a grid, or array format wherein the underlying display may still be readable.

Alternatively, the spheres of electronic ink may be embedded into or on the surface of the photoresponsive material, of course opposing electrodes for at least resetting the eInk display should be incorporated.

Furthermore, the photoresponsive material itself may be incorporated within each sphere of the electronic ink. The sphere themselves then generate their own charge potentials based on received light and convert from one state to the other. This may be utilized with dual-sided material or with single sided material in which the potential generated by the photoresponsive spheres is overcome to redirect and reset the material in response to a sufficient bias voltage.

Heat responsive material: Similarly photoresponsive material may be manufactured which is responsive toward the infrared region and heat, wherein a voltage output is generated in response to thermal input.

Method of gray shading material: By variegating the photoresponsive properties of the photoresponsive materials over, within, or beneath the electronic ink sphere matrix and providing a biasing voltage that may be overcome by the voltage generated by the photoresponsive material, the material may be made to be continually responsive to the amount of light or heat, wherein it can change back and forth between colors based on light or heat being received.

Another method of gray shading material: the activating potential required for the electronic ink spheres may be variegated. For example: (1) The composition of the spheres or size may be intentionally fabricated to require different energizing potentials. The spheres are dispersed randomly, or selectively (to control shading by controlling the cross over point) wherein the surface can change from one state to the other in a pixel by pixel gradual transition as the voltage across the spheres increases. (2) A textured film may be deposited between the plane of the eInk spheres and the electrode, wherein since the electrical potential drops off as the square of the distance, the eInk spheres will have a transition point that is responsive to the amount of film deposited between the electrode grid and the eInk spheres.

Varying the color changes to a surface: Interesting and useful optical effects may be realized for altering the color of a surface in response to the electrical potential across the surface using electronic ink spheres. By incorporating different electronic ink colors within spheres configured for transitions at different electric field strengths the material may be made to transition through a range of colors. For example loading a first set of spheres configured for switching at a first voltage V1 with a yellow "ink", a second set of spheres configured for switching at a second voltage V2 with an orange "ink" and a third set of spheres configured for switching at a third voltage V3 with a red "ink". The spheres can be randomly disbursed or according to any desired shading. The color provided by the surface then be varied from yellow through orange and red according to the voltage provided across the surface. It will be appreciated that by an opposing set of colors may be defined when the eInk is made to transaction in the opposite polarity direction. For example—First set white when negative and turn color on going positive and a second set white when positive that turns color on going negative. This method may be combined with other techniques described herein.

Furthermore, the two types of material that fill the sphere may provide for a color shift that is not recognizable within the human color spectrum. A first fluid material that absorbs radiation away from the visible color spectrum, such as infrared, or preferably ultraviolet, may be coupled with a material that reflects radiation in the same band. In this way the transitioning of the material may be invisible to the naked eye yet be visible to optical detectors used within a given non-optical range of frequencies.

It should also be appreciated that the term "ink" as used herein comprises any materials that may be inserted within the microspheres of the electronic ink, typically a fluidic material, whose position can be altered by the application of an electric field. Although oils are typically utilized within electronic "inks", they will be referred to herein as "inks" irrespective of the actual composition.

Light programming in either direction: It will be appreciated that the biasing voltage across the material may be altered so that the voltage generated by the photoresponsive material can program the electronic ink spheres in either direction as desired for a given application. This may be performed dynamically, such as light being received to program portions of the material under a first biasing arrangement and then to erase portions of the material when subject to a second biasing arrangement.

Toggling color shift response: the voltage output from the photocell layer is coupled to a comparator fed to a toggle flip flop, or similar circuits, whose output is coupled to the electrode grid across the eInk material. Preferably a capacitance is provided at the flip flop wherein state is retained in the absence of light. When the light being received crosses a transition point, toward light or dark, the comparator is triggered and the edge toggles the T-FF into the opposing state. This mode for the material can allow the exterior color to be modulated according to received optical transitions. Simple circuitry such as the T-FF and so forth may be incorporated into polymeric material so that the feature may be incorporated into sheets of material whose sections are connected to a circuit element which modulates the exterior color based on the changes in registered light.

Oscillating or animated color display—These can be produced by combining a power source, such as provided by the photocell form of material films (e.g. heterolamellar photoelectrochemical films), with simple circuits that may be screen printed on the base material for controlling the state of spheres of electronic ink. It should be appreciated that the photoelectrochemical film and the simple circuits may be fabricated using inexpensive processes, such as in poly, while the electronic ink display with front and rear electrode may be fabricated easily. (e.g. deposit conductor, deposit a transparent carrier liquid containing eInk spheres, once hardened another conductor may be laid down over the eInk layer for the opposing electrode.

By way of example and not of limitation: A first photocell layer, may be implemented in a number of alternative ways for energizing a simple circuit and preferably storing charge on a capacitor. The simple circuit may be utilized for discharging the capacitor, thereby creating an oscillator having a varying voltage output waveform, such as a triangular waveform pattern, which ramps up to V1, at which time a switching element having voltage threshold, such as a FET, discharges the capacitor back to near ground potential The output of this oscillator may be utilized for driving a first electrode connected to one or more sections containing electronic ink. The output of a second photocell layer, may be utilized to generate a fixed bias b=voltage or varying voltage as applied to a second electrode connected to the opposing side of the eInk. Electronic sections may then be alternatively sequenced on and off. Furthermore, using spheres having different threshold voltages, various color changes may be effected, as well as animation effects and so forth. These forms of animated simple displays may be cheaply produced as plastic labels which may be adhered to articles or wrapped on surfaces and a wide assortment of additional uses.

Photocompliant surface: The photoresponsive material may connected to a signal processing device to detect the amount of light striking the surface, while the eInk material may be connected to the signal processing device for controlling the shading of the material and the reflection therefrom. This mode may be optionally selected as the signal processing device may selectively alter the setting of the eInk sphere in response to the optical energy being received, choose to modulate the eInk spheres independently of the received energy, or provide any desired combination thereof.

The present invention be incorporated in a variety of displays, the following are provided by way of example and not of limitation:

eInk signage: such as roadside signage, that may be programmed using a laser pointer, or similar light source.

Hazard tape: changes colors in sequence so that it is easier to see.

optical storage media: the material may be used for storing binary information in response to light programming. The available density, however, is expected to limit the technique to select applications.

Screen capture paper: Hold it to screen and activate it to set the orientation of the display elements. Typically would require the use of an external biasing and resetting supply that the edge of material can be engaged within to supply power on system.

X-rays: photoresponsive material may be adapted to respond to electromagnetic radiation in the x-ray spectrum, wherein the material may be utilized for directly recording x-rays onto the material without the need of photographic processing.

Blackboards: instructor can write from a distance using laser pointer.

Airborne displays: Allows viewing of material in high ambient light situations in response to display lighting. For example the dirigible display described herein may be configured with a light responsive interior layer that converts the laser light into a voltage which programs a sparse eInk layer on and otherwise translucent material. In this way the light from the internal laser is visible at night while the electronic ink is viewable during the day.

automated camouflage: A covering may be created for personnel, vehicles, aircraft, and so forth that responds to the amount of light present to adjust the darkness of the surface. The material can be biased toward a first setting, such as toward being dark, light impinging on the surface raises the electrical potential of the photoresponsive material, and turns elements on. The photoresponsive material is preferably overlayed in a variegated pattern wherein the underlying elements are responsive to differing amounts of light energy. In this way the material slowly shifts color (or shade) depending on the amount of light present. This is important as when one is hiding in the shadows the camoflage should darken, however, in the light it should be a lighter color. Any conventional base colors may still be supported according to the conditions, such as jungle camo, desert camo, and so forth, while the eInk spheres operate to change the shading of the material by being able to alter from a darker "ink" to a lighter "ink" and so forth in response to impinging light. It should be appreciated that the above techniques may be applied to different forms of electronic ink displays without departing from the present invention.

Environmentally responsive covering materials: Materials may be created that help to pick up heat when it is cold and reflect heat in response to intense sun exposure. The material is biased toward an absorption state, preferably black, and in response to sufficient exposure to the sun it changes to a white state. When light drops the biasing resets the material back to a dark state.

16.0 eInk—Enhanced Consumer Package Labeling.

The present inventive aspects allows increasing the attractiveness and attention-getting-ability of consumer packaging. Low cost active packaging enhancements based on electronic ink and inexpensive polymeric circuit fabrication techniques have been generally described, it will be appreciated that polymeric fabrication is known in the art as are eInk material. Polymeric material may be printed using generally conventional processes wherein simple circuits may be fabricated. Herein the electronic ink is applied to the surface of polymeric circuits that provide simple slow speed oscillators, which may be coupled through memory cells, or simple sequential circuits for activating selected electrodes beneath, or above, the layer, or layers of electronic ink.

These labels may be printed directly on the package using conventional printing techniques, or printed on sheet labels which are then cut out and applied to the exterior of packaging.

These labels can provide a number of functions to enhance consumer packaging.

Color changing labels—change periodically, based on lighting, or heat, and other easy to detect properties.

Animated labels—different sections of electronic ink are sequentially activated and other deactivated, wherein the labels are more eye-catching.

Indications of exposure to temperature extreme—the color changes permanently to register that the package has been exposed to temperature extremes. Furthermore, a layer of polymeric circuit may be embedded to move the location being written after each temp extreme wherein a series of temp extremes may be recorded, such as in a bar graph with the extreme being recorded in each bar.

Shock exposure—the tags change color overall or in locations, such as described for the bar graphs in response to shock which may be readily detected using membrane switch contacts set for different thresholds.

Applied as stickers, labels, wraps, fastened to surfaces with adhesives, fasteners, and so forth.

One or more elements incorporated within the printing process—eInk, photoresponsive material, circuits, may each be printed on the surface of the packaging in layers to create the desired effect.

17.0 Secure Data Communication Methods.

The present aspect of the invention provides additional methods for providing secure communications and monitoring, such as applicable to military or police actions.

It will be appreciated that providing secure communication between two points is often difficult, in particular in military situations. The encryption of a radio communication is always subject to decryption, often leaving the use of two way laser as the only viable option. However, it is often especially difficult to retain two laser beams directed toward one another, in particular is one of the elements is mobile or unable to recognize the position of the other element.

The present invention provides methods for directing two laser communication system and for using providing two way communication with a single laser beam between and first and second point.

Figures 21, 22:
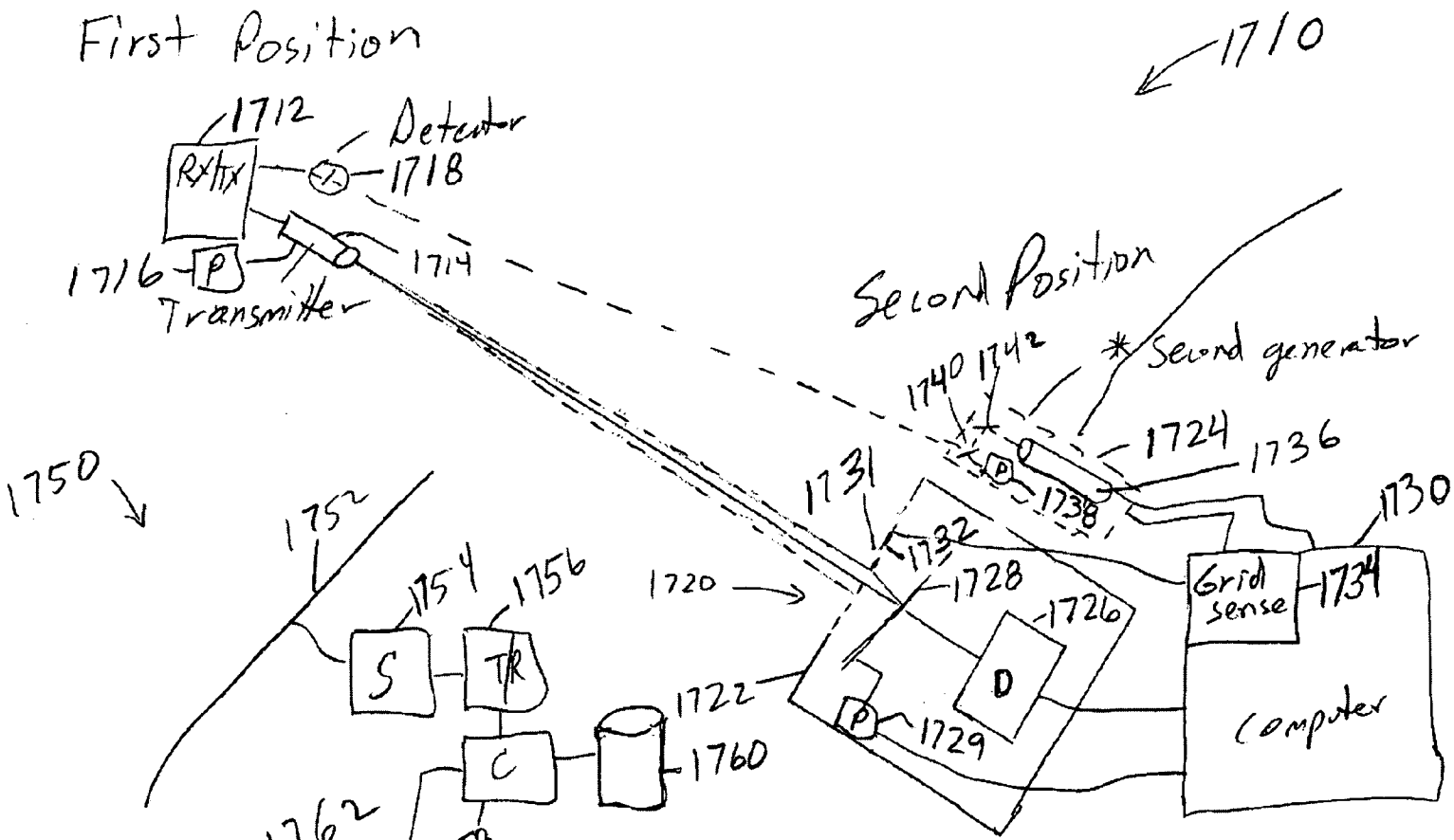
FIG. 21 is a block diagram of an optical communication system according to an embodiment of the present invention.
FIG. 22 is a block diagram of a two-way communication system utilizing a light responsive display according to an embodiment of the present invention.

FIG. 21 depicts a block diagram of elements within a communication system 1710. The following describes the general elements which may be used in the system which is followed be a description of a few operating modes that the system may be utilized.

A first position has an optical transmitter/receiver unit 1712, with an optical transmission source 1714, such as a laser of any desired wavelength whose direction may be controlled using a positioner 1716. It will be appreciated that the second position may then be "painted" using the positioner wherein the light impinges on the second position from the first position. The laser source may be configured to have any desired amount of spread so as to simplify maintaining optical contact from the first to second position. The first position may be an airborne platform such as an aircraft. for instance an AWACs flying above a given location. A detector 1718 may be colocated with the transmitter or at any desired separation. The second position 1720 has a receiver unit 1722 and an optional second optical transmitter 1724. A detector 1726 within receiver unit 1722 is responsive to the impinging light to receive the signal from the first position. The detector may comprise an array so that the position upon which the light striking the detector may be determined.

A partially silvered mirror 1728 is retained in the path of the incoming optical energy and its two axis deflection is controlled by a positioner 1729 as controlled by a computer 1730. The housing of receiver 1722 is configured with an aperture or transparent section 1731 through which the optical energy may be received. The aperture or transparent section may be adapted with an optical detector array, either on the surface of the transparent section or around the periphery of the aperture, wherein the direction of the reflected optical energy and/or the impinging optical energy may be detected and registered by computer 1730.

It should be appreciated that the rough direction of the first position in relation to the second position may be determined by the path from the center of the detected light (or a feature therein) and the center (or a feature therein) which impinges on the detector 1726. It will be appreciated that a number of mechanisms exist for detecting this relative orientation.

The optional second optical transmitter 1724 is configured with an optical source (i.e. laser) and a positioner 1738 which may be used to control a mirror 1740 that deflects optical energy from a first mirror 1742 to a desired target (first position).

The following are in reference to FIG. 21.

(1) Modulating the reflection of said laser from a second position back to first position transmitting the signal.

Upon receiving a verified signal impinging on the second detector, mirror 1728 may be modulated to reflect the light back to the first position according to an embedded low bandwidth signal, that for example has been programmed for transmission upon the receiver being painted with a verified signal. It will be appreciated that a fairly precise location for the first unit may be determined by detecting the reflection generated from the mirror and matching the outgoing reflection with the incoming signal.

Mirror 1728 may also be provided, or include, a shutter array such as an LCD shutter array, that is capable of being switched on an off to alter the path length of the optical energy from first to second position. The transceiver at the first position may then detect the modulation by detecting phase shift changes according to the modulation. This method increase the updirection bandwidth.

(2) Directing the second laser to the first laser source.

The direction detected by the receiver and the reflection from mirror 1728 being nulled toward the signal by sensing reflections on detector 1732 is used for controlling the direction of optical source 1724.

(3) Optical modulation of large surface on vehicle for communicating information:

FIG. 22 depicts a very simple two-way transmission between the first and second position. This embodiment incorporates by reference the invention "eInk—Light Responsive Display (LRD)" described elsewhere.

A friendly target position 1750 is shown having a surface 1752 that is fully, or partially covered, by the "photocompliant surface" described which is connected to a signal processor 1754, a transceiver 1756, computer 1758 having a data storage 1760 and user interface 1762. The surface may comprise a panel, a plurality of panels, or a surface on a vehicle, or be manually deployed, such as by a foot soldier.

Communication to Target:

Surface 1752 detects when an optical signal, such as from a laser source, (from AWACs, aircraft, vehicles, and other allied installations) signal modulated according to given pattern impinges on its surface as registered by the voltage (or other electrically responsive characteristic such as resistance, capacitance, inductance, and so forth) registered by the signal processor 1754, decoded by receiver 1756 and communicated to computer 1758.

Friend or Foe (FoF):

In response to a friendly target being painted by the optical energy, the target evaluates the modulated signal being received and if it matches the coding for a friendly FoF transmission, then the setting of the electronic ink on the surface of the friendly target is modulated to respond to the FoF signal which can be detected by at the transmitting site according to the amount of detected reflection from the friendly target.

Responsive Communication:

Similar to the FoF response, the friendly target may communicate with the transmitting site by modulating the amount of reflection created by the surface, such as by modulating the state of the electronic ink spheres as described. This communication may occur in real time although the bandwidth is limited, in particular from the friendly target back to the transmission site, by the rate of change of the color of the material.

Preferably, the friendly target encodes information into the computer system 1758 from the user interface 1762 which is stored electronically 1760 until triggered, such as by receiving the verified transmission from the transmission site.

It will be appreciated that the communication between the transmitter and target may be preferably encrypted, such as using a variable encryption whose algorithm varies according a selected pattern in response to time as registered by an clock, such as an atomic clock.

The invention allows a transmitter site to securely communicate with friendly vehicles without the need of sophisticated laser communication equipment on the friendly equipment. For example an AWACs aircraft may communicate with a number of ground based friendly forces using an optical line of sight transmission that need not be precisely targeted on the friendly force vehicle, or individual with deploying a photoresponsive panel, or having clothing that is photoresponsive.

In addition, it will be appreciated that conditions may be reported by displaying encrypted information by modulating the optical properties, (reflectivity and color) of a large surface area, such as the exterior of a vehicle for example using the eInk technology described, wherein satellites and other distant optically enabled devices may register the optical modulation of the large surface area for maintaining status information on the vehicle, building, personnel, and so forth associated with the large color responsive panel.

For example, vehicles fully or partially covered by the material can continually transmit status information by modulating the color of the exterior. Note that the color change need not be recognizable by the naked eye and may only be seen in toward the infrared or ultraviolet region of the spectrum. A status of an entire battlefield scenario may then be determined from an optical platform that can view the exterior of the vehicle (or panel) sufficiently and detect and decode the color modulation transitions.

(4) Adaptive Camoflage—

The color changing of the vehicle described above can be used to provide selective exterior camoflage of the vehicle. The electronic ink surface may be set for a given color which is best suited to the situations. Furthermore, sections of the electronic ink may be configured for separate programmability, wherein the patterns of color on the vehicle can be controlled. It will be appreciated that electrode grids may be dispersed over the surface similar to the display applications described earlier, and connected to a computer within the vehicle (buildings, bunkers, radar equipment, truck, tank, car, aircraft, helicopter, canon, personal clothing, and so forth) which accepts a user input for selecting the color pattern to be displayed.

Another aspect is to provide cameras directed out from the vehicle, in particular this is applicable to tanks and so forth, wherein the camera detects what the background for the vehicle is and programs the setting for the colors of the electronic ink to perform a best match of the background. For example a rear pointed camera detects a road above which bushes are found and the computer performs image processing to pull out the color bands which are then sent to the different areas of the electronic ink exterior wherein the lower portion of the vehicle display a dirt color similar to the road and the upper portions appear in colors that match the back ground bushes. Cameras in other directions would likewise register the background for changing the colors of the vehicle on the opposing sides. Another aspect of the invention is registering target location, such as on radar, (or best guess at location) and using this data to control the coloring wherein the viewing angle is taken into account. For example a view from a higher angle would place the dirt color section being displayed at a lower level on the tank. This provides a compensation mechanism wherein the camo becomes more realistic. The viewing angle may alternatively be manually controlled, however, this could prove a distraction to crews. It is anticipated however, that special circumstances may warrant manual colorization selection, such as during maneuvers (signaling which side the unit is on, the unit being hit [red], or other conditions).

In this way the vehicle is camouflaged readily and immediately and could really confuse an enemy as the colors of the vehicle morph while moving.

(5) Holographic Camoflage—

The above technique may be improved upon by incorporating holographic imaging techniques with the electronic ink. It will be appreciated that optimum camoflage depends on the angle of view. For example in the example above, the colors set on the front and top of the tank may provide camoflage for a vehicle at the same height as the tank, however, an aircraft, or other vehicle with a different viewing angle would viewing angle A number of holographic techniques are available for generating holographs from computers and holographic recording of information onto disks is heading rapidly toward commercialization. It is contemplated that the use of holographic generation techniques with the color changing exterior of vehicles, as described above can facilitate the creation of camoflage. Multiple depths of eInk are provided with a predetermined relationship which are programmable by a computer. The computer registers images from the surroundings and creates a 3D simulation from which holographic images are generated on the exterior by controlling the planes of eInk. In this way the vehicle will appear exactly as its surroundings (depending on color range and color depth for the eInk.).

18.0 Laser Sign Embodiments.

This aspect of the invention provides for creating inexpensive lighting displays such as for outdoors, buildings, and so forth.

A number of embodiments are described herein and in the attached notebook pages. One form of embodiment utilizes an elongated multisided reflective member to distribute light from an array of lasers directed at the reflective member to a screen, which may be viewed directly or from the opposite side. For example, the side of a building or a semi-opaque, semi-transparent screen for viewing the opposing side, or a material layered with reflective material for viewing the reflection.

Beam scanner display methods are utilized wherein one only needs a single laser LED source per display row and the row can span a field of about 60°. The laser LEDs light is bounced off of a rotating mirror assembly we call a "splasher". The "splasher" is formed with variously angled and formed mirror surfaces that form a cylindrical structure. The "splasher" in essence becomes the row scanner for the whole sign, and no separate column drives or even LEDs are necessary. The system of this invention is referred to herein as a BeamScan system.

A large building sign whose cost to manufacture and install would add up to over $100 K can be built and installed for well under $10 K. Currently each large LED style unit is usually custom built because each installation has needs of a different number of rows, columns, colors, dot size, etc. With a BeamScan system you just program it for size. For big variations in use a different "splasher" may be employed. Additionally the units can be put up so easily that it now makes sense for them to be leased or rented out!! Sign companies can demo it right on the side of a company's building, Hotel, Motel Warehouse, Outhouse or projection screen—anywhere. Even small indoor signs found in businesses can now be made smaller and much cheaper. Imagine a can of corn that plugs in and projects your message on a single wall, on a ceiling, or even high on the walls that surround the entire room.

BeamScan can be used behind a translucent panel as a backlite display or in front for a projection display.

Even color displays can be created using BeamScan technology by using co-located laser color sources and electronically mixing them as they are projected.

Commercial Applications—Large Units: Splatter>18"

Advertising on sides of any buildings, hotels, etc. A new market opens up due to the lower cost of these displays. Signs can be sold, leased, or even rented for special occasions.

Permanent signage—uses where LED signs are used now. The signs can be augmented with BeamScan technology. New thoughts:

Add a translucent panel section on top of building around the perimeter, project a continuous scrolling sign onto it.

Highway signs—back or front lit with BeamScan. Can use a horizontal splatter even with top of sign and projecting Retail Sales Applications—Small Units: Splatter<18"

Outdoor signage in environmentally protected areas

Indoor signage for businesses. Project company news and info/advertising etc. Small units above doorways can project to opposite walls. Even a small desktop cube that can project to a wall or ceiling.

Figure 23:
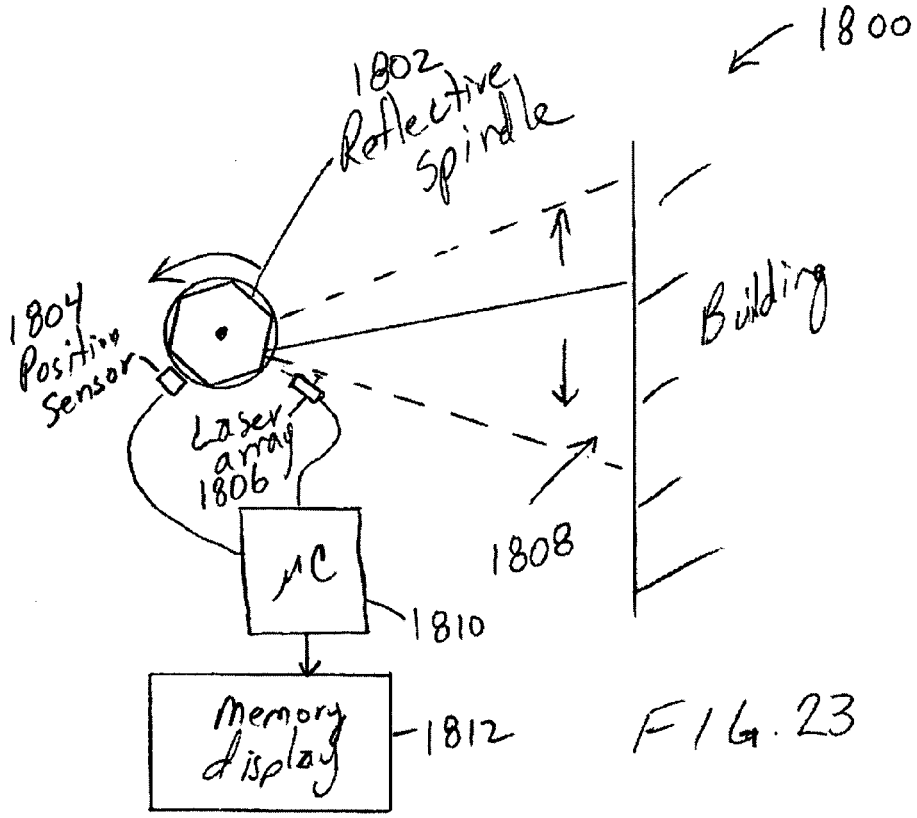
FIG. 23 is a side view of a beam scanning display according to an embodiment of the present invention.

FIG. 23 depicts a beam scanning display 1800 according to the invention, having a reflective spindle 1802 (here shown hexagonal) which rotates at a given speed and whose position is registered by a position sensor 1804. An array of lasers 1806, shown vertically arranged, is directed at the reflective surface, which is reflected onto the side of the building 1808, or other form of viewing screen. The output from the elements within the laser array are then modulated by ac controller 1810 according to what is to be displayed on the screen (building), as decoded from data contained in a display memory 1812. The position of the reflector determines what area of screen is being "painted" by the laser and vertical row of pixels output by the laser array. It will be appreciated that this embodiment provides a raster scanning form of display, wherein the decoding circuits and programming will be known to one of ordinary skill in the art and not described herein.

Figure 24:
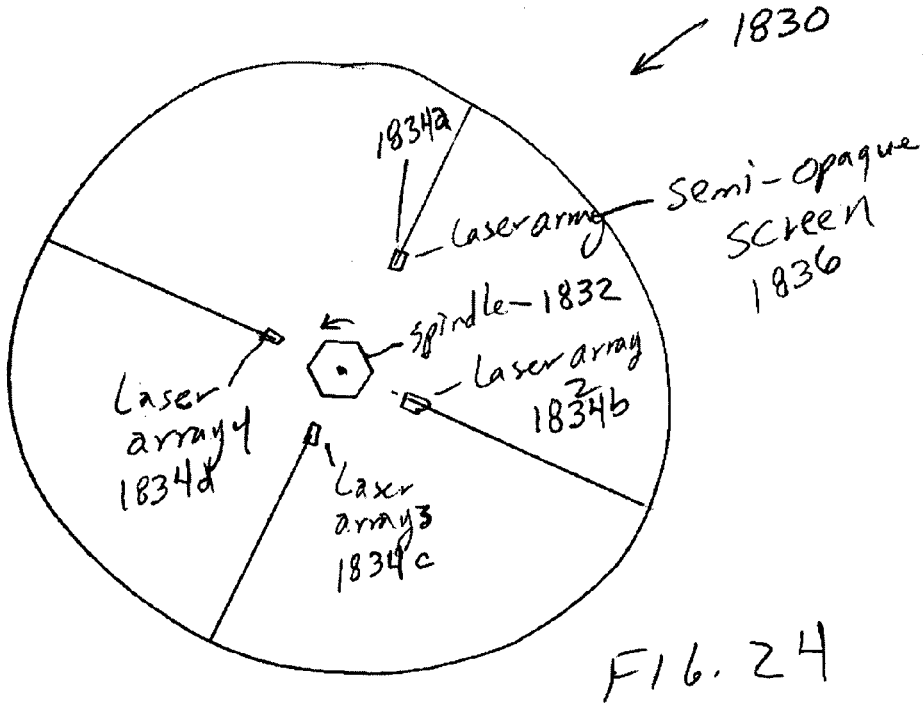
FIG. 24 is a top view of a circular display utilizing a rotating beam splatter according to an aspect of the present invention.

FIG. 24 depicts a circular display 1830 embodiment created using a single rotating reflective element 1832 with multiple laser array heads 1834*a*, 1834*b*, 1834*c*, 1834*d* to display information around in the circle bounded by rear-projection screen 1836. Such as display would be useful in many applications, such as within the center of the building that may be viewed on all sides, such as for convention centers, movie houses, airports, gymnasiums, and the like.

Figure 25:
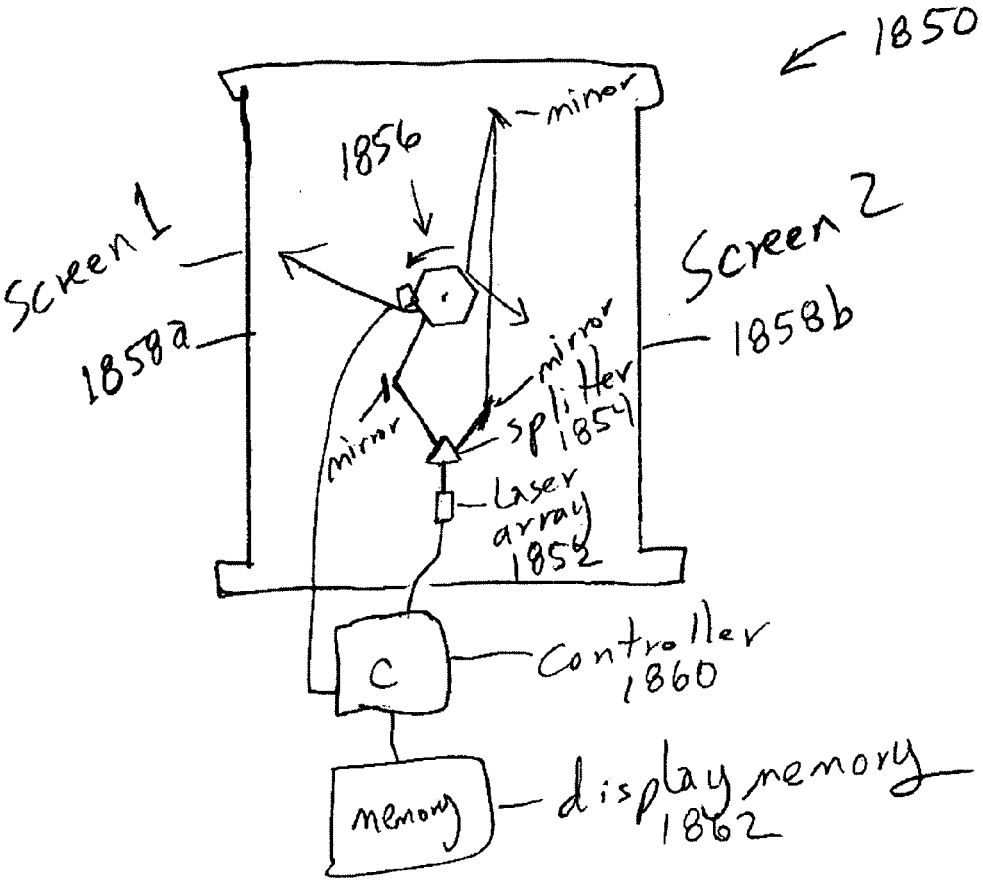
FIG. 25 is a side view of a two-sided beam scanning display according to an aspect of the present invention.

FIG. 25 depicts an embodiment 1850 of a two-sided beam scanner display such as is particular well suited for roadside use. Although two banks of lasers may be utilized with a single reflector, (splasher) a single laser array 1852 is shown being split into two beams, by beamsplitter 1854, one being directed by a single mirror to a first side of a splasher 1856 and a second being directed through an extra mirror to the second side of splasher 1856. Beams reflecting from splasher 1856 are directed upon the backlight displays 1858*a*, 1858*b* from which they reflect to display on the first screen with a mirror image displayed on the second screen. It will be appreciated that the cost of the display may be reduced in this instance by eliminating an extra laser array.

By adding a second laser array controlled by controller 1860, images may be producing with the correct left to right orientation, while utilizing a single splasher and splasher drive control.

Laser Scan Alarm.

The present inventive aspect can thwart thieves both from intimidation and detection. The present invention utilizes a laser whose output is controlled through a multidimensional reflector system, such a XYZ reflecting stage, so that the laser light can cover a portion of the area of a room. An optical sensor provides for detecting the lighting being received back by the unit from the reflections. The alarm is configured to sense a particular "signature" of reflected light and to generate an alarm/alert should that signature deviation cross a threshold value.

Embodiment 1

A mechanical stage operates to direct an optical head in three dimensional patterns from preferably at or slightly below the horizontal, up to the vertical, (or the opposite for a ceiling mounted unit). An photosensor (preferably tuned to the light being output such as its IR or UV components) is coupled within the head and shielded so that only a small area of incoming light is registered which corresponds with the location that the laser light is striking.

Figure 26:
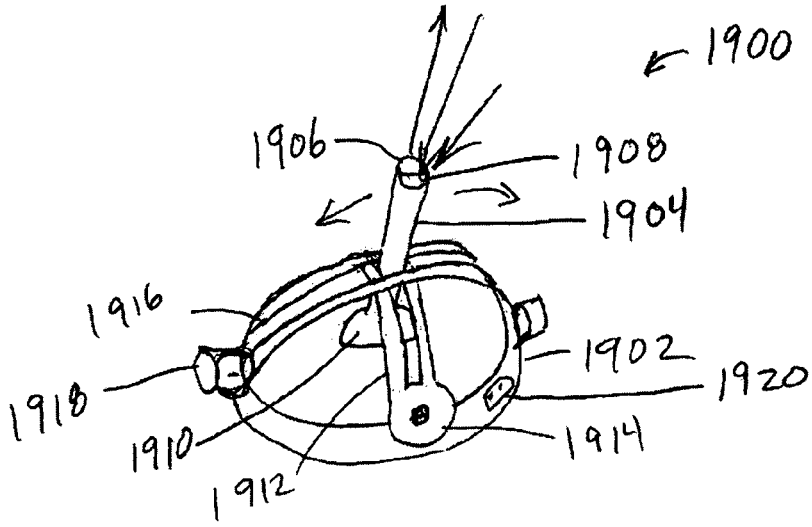
FIG. 26 is a perspective view of a laser scan alarm device according to an embodiment of the present invention.

FIG. 26 illustrates an example of the alarm device 1900 with a base 1902 detection beam member 1904 having a first passageway 1906 for transmitting a collimated beam and a second passageway 1908 for collecting a collimated beam from the same direction as the first beam was directed. Base 1910 of beam member 1902 is retained within a ball joint to allow motion in both angles about the pivot point, wherein the area above base 1902 can be checked by the unit for motion and abrupt optical changes in the surroundings.

Detection beam member is moved, in this embodiment with a first gimbal 1912 coupled to an actuator 1914 (i.e. stepper motor), and a second gimbal 1916 coupled to a second actuator 1918.

An optional connection interface 1920 is shown allowing a user to program how the unit is to operate, for example over a USB port of a computer connected to the web site of the manufacturer. Alternatively, a conventional user interface can be supported, which is well known in the art.

Figure 27:
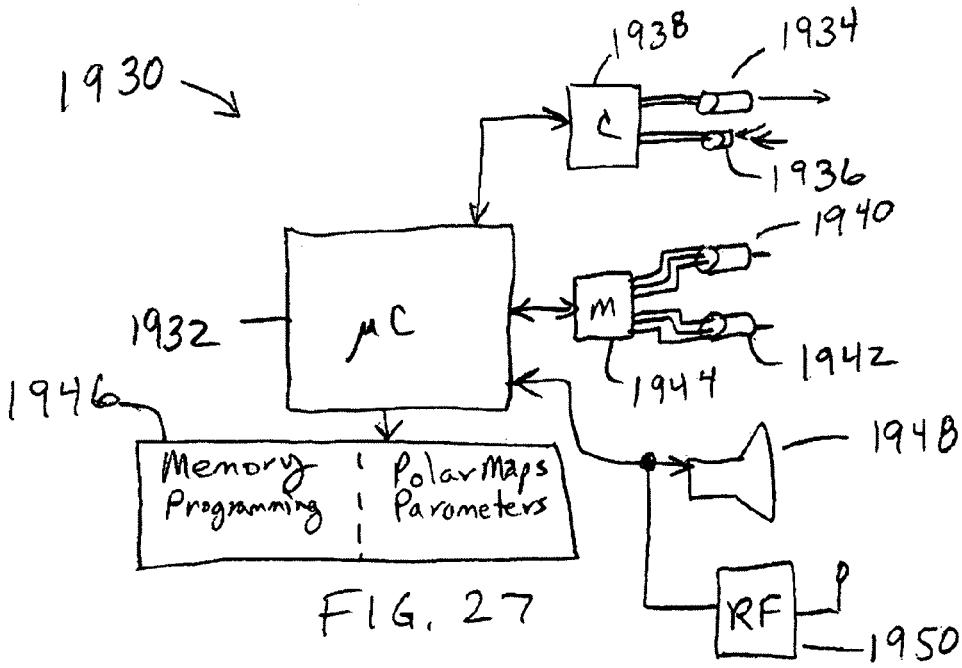
FIG. 27 is a schematic of the laser scan alarm device of FIG. 26 according to an aspect of the present invention.

FIG. 27 depicts an example of circuitry 1930 for alarm 1900. A computer 1932 (i.e. microprocessor) controls the orientation of the unit and the output of laser 1934 and input from optical detector 1936 through a control and conditioning circuit 1938. Detection beam member 1904 is directed utilizing motors 1940, 1942 via a motor controller 1944. When scanning it is preferable that a random or pseudo random pattern be followed wherein an intruder could not easily escape detection by getting in such with the pattern.

The sensor input 1936 comprising reflected energy from beam 1934. Preferably the output of beam 1934 follows a rapid on and off sequence (spread spectrum so won't be in synch with any electronics), wherein the contribution to the return signal from ambient conditions is filtered out. The reflected energy is compared against a reflection map stored in memory 1946 spanning the area being checked. Intensity values (and optionally composition (i.e. color)) can be stored as values filling a three dimensional array (polar angle, elevation, time). The time axis being included to allow return values to be compared over time (temporal filtering of alarm conditions). The system constantly maps out the reflections being returned and checks for differences which would be indicative of smoke, fire, or intrusion, wherein an alarm is activated or an alert such as via telephone generated. Upon detecting changes in the surrounding environment, the beam member 1904 is directed about that area to gather additional information in validating the alarm. It will be appreciated that the beam 1934 can check the area according to need, and environmental changes. Upon validating an emergency situation, an alarm is generated by audio annunciator 1950, and the alarm may be communicated remotely, such as by RF transmitter 1950.

One method of comparing the returned reflections for a periodic pattern of received reflectance energy is to take reflectance values at a given periodicity, to store these in sequential memory address starting at location A, then on a next cycle to compare the new value with that which was stored, if a large difference exists then a flag may be set for verifying this location for an alert condition, and the new value averaged and stored in the memory array starting at location A. On subsequent passes the changes are verified for this or nearby locations, wherein an alert indication may be signaled.

To increase the accuracy of the determinations the present system can store a collection of running average values for each direction. For example consecutive sets of locations (arrays) in memory wherein accessing between one array to the next is controlled by altering higher order memory bits, such as if the array is 256 locations (lower 8 bits of address 0–7), then by altering bits 8–11 of the corresponding location within 16 different arrays may be written to read.

The display may be used to generate a substantially random pattern, wherein the spatial relationship between different reflectance readings can be compared by storing the values in locations according to spatial direction (presorting) wherein reflectance differences in a given region are compared with that region (perhaps not exact location) at some later time (time between passed unknown as passes here are random).

When the unit detects what appears to be an intrusion situation it can temporarily constrain its focus toward that area to get more data, wherein the light output can be seen to be directed at any areas where any change is detected. This helps reduce false alarms, while it is a deterrent because the laser will begin being directed to a party that even comes into the periphery of the beam.

This laser output from the alarm is aesthetically very pleasing and it can be configured as a miniature desktop alarm that could appear much like a domed glass paperweight. It will be appreciated however, that the unit may be used for building monitoring, and may be mounted in corners, on ceilings, or on floors, and so forth.

Embodiment 2

The light may be splattered from a rotating reflector. For example, if the incoming light is oscillated, in a pattern having a vertical component which impinges on a rotating reflecting surface having a curve with (horizontal equiradial lines) then the light striking the surface will be spread in three dimensions, albeit over a limited cone in space. This may be similar to the splatter mirrors described previously yet with each mirror being offset to spread the laser light. It will be appreciated that in this embodiment both the laser light and the splatter reflector may be driven by a simple motor to generate rotation. It may be more difficult, however, with this embodiment to evaluate the returning light for changing reflective components due to the indirect nature of the generated light, the reflection coefficients from the mirror surface and the positional inaccuracies.

20.0 Entertaining 3D Laser Display.

The present inventive aspect can provide an entertaining 3D laser reflection display that is low cost and robust.

The present apparatus is very similar to that described above for the laser sign embodiments utilizing a light splatter unit, but can provide more varied angle output since it is not comparing the returned reflectance signals in relation to a space mapping for differences. This entertaining display can be used for disco style light shows, aftermarket automotive displays, such as dome light or a look forward projection light (constrained projection angle).

One advantage of this device is that it can spread a single beam of light over a larger angular area in comparison with rotating mirror-faceted spheres which reflect a beam back toward the same quadrant requiring multiple light sources to spread the light to all parts of the room.

Light direction is modulated in a first axis (or preferably in two axis simultaneously) and then directed to impinge on a reflecting surface which directs the light along a second axis (or preferably in two axis). The resultant light pattern can be scattered over a large spatial area providing an entertaining display.

Figure 28:
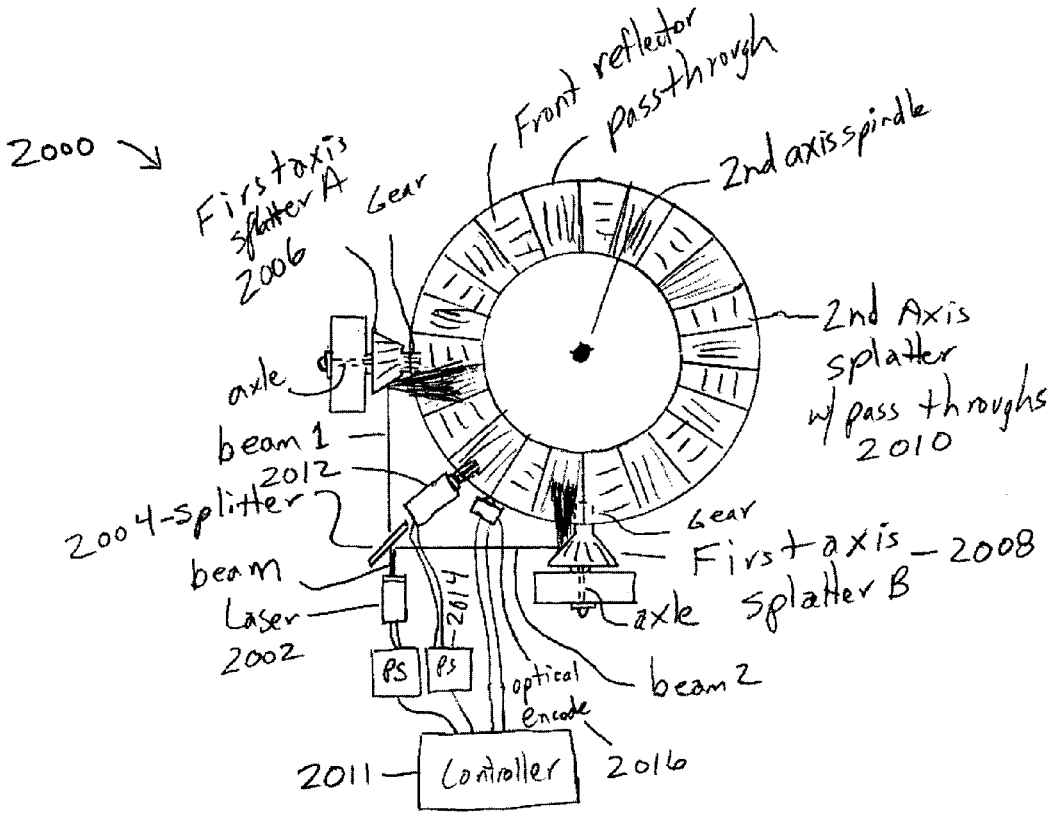
FIG. 28 is a top view of a 3D laser display according to an embodiment of the present invention.

FIG. 28 is an embodiment 2000 shown by way of example, with a laser 2002 directing light to a splitter 2004 (e.g. half-silvered mirror) which splits the light toward two first axis splatters 2006, 2008 (A & B). These are configured with reflective sides having facets that as the splatter rotates the light is modulated vertically, or optionally both horizontally and vertically. The light "splatters" from the reflecting surface onto a second reflecting surface on a second axis spindle 2010, wherein it is displaced in at least one but preferably two axis. In order to cover a large spatial area second axis splatter 2010 is preferably configured with pass through slots that allow the light to cross over and reflect from a rear surface reflector on the opposing side of the second axis splatter. Using the split beam directed at perpendicular locations on the second axis splatter allows light to be splattered in all four quadrants about the second axis splatter, in addition to angles proceeding up therefrom.

If light is to be directed from the back side direction as well, then another second splatter may be coupled to the back of the original and each half of the laser split (i.e. prismatically) just before striking a first axis splatter which is mounted substantially symmetrically on the centerline of the coupled back to back second axis splatter. In this way a substantially large 3D coverage area can be supported with a single laser and very simple structures.

A control circuit 2011 regulates power to a the laser 2002 and motor 2012 having an output coupling such as a gear which drives secondary splatter 2010, the underside of which has gear teeth enmeshed with the two small splatter devices 2006, 2008, wherein they move following the large splatter. An optical encoder is shown 2106, allowing a microcontroller (if one is used) to monitor the speed of rotation for adjusting aspects of the display.

Figure 29:
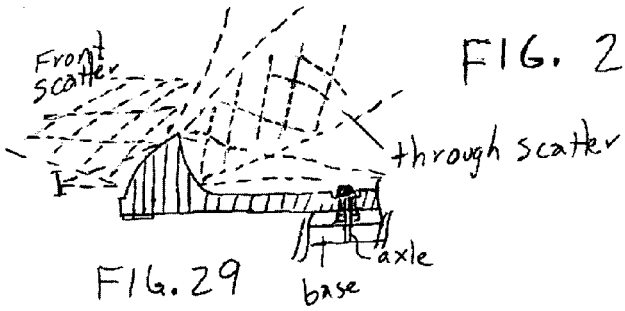
FIG. 29 is a side view of the compound reflecting element of FIG. 28.

FIG. 29 illustrates the ranges of reflection from segments of second level splatter 2010, wherein it is seen that an angle covering over 135 degrees may be spanned, and this span is generated in all four quadrants about the periphery of the unit.

21.0 DerigDisplay.

This aspect provides an active display that may be viewed from a distance, such as in advertising signage.

A floating sign according to this aspect of the invention, herein being referred to as a dirigible, of any desired shape is filled with helium for buoyancy and configured with an internal projective lighting system for displaying messages on the interior of the dirigible which are visible from the exterior of the dirigible.

Figure 30:
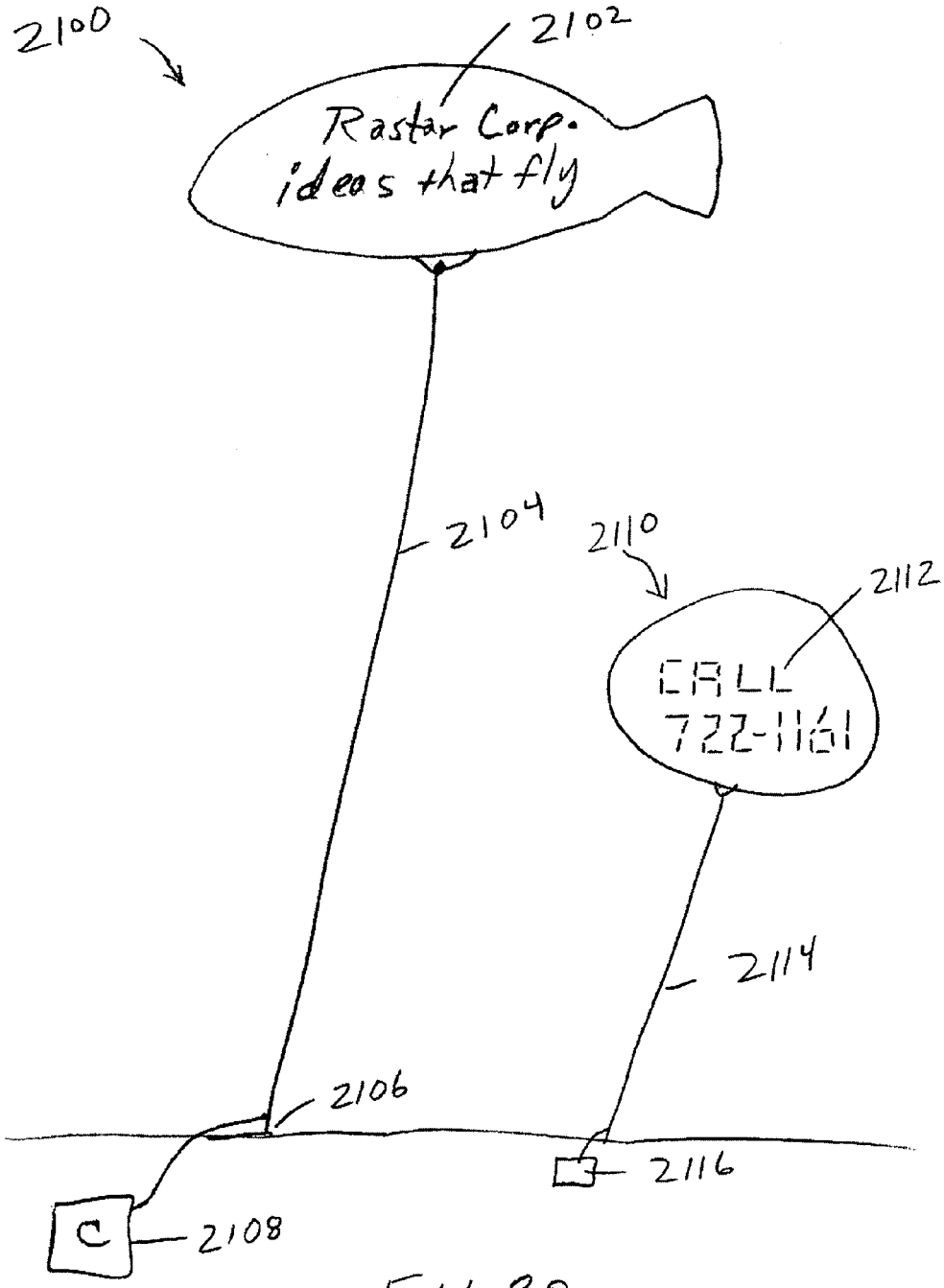
FIG. 30 is a side view of a floating electronic sign according to an embodiment of the present invention.

FIG. 30 depicts a dirigible 2100 with display 2102 connected via cable 2104 to an anchor on the ground. Control and power are routed from a control unit 2108 up the cable. The unit is connected through a connection with the ground that also provides a low voltage power and ground for the device. Additionally, the connection may include signal lines such that the controller for the device need not be within the unit, this can reduce the weight to some degree.

Embodiment 1—Laser Stage

A three dimensional reflective laser stage is provided at the center of the device, preferably utilizing a number of MEMs mirrors for directing the light from the laser in a vector mode toward any desired position on the interior surface to write a message. The necessary speed of the laser can be reduced by layering phosphorescent material on the surface of the balloon, which keeps retains energy providing persistence between refreshes.

A single laser may then be used to save on power and weight requirements. The laser is modulated and the stage controlled so that messages may be written on the interior of the dirigible which are visible on the exterior of the unit. This unit may be similar in construction to the laser scan alarm described above, with both text and graphics may be displayed, even shades of gray by modulating the laser light at high speed to reduce effective intensity.

Embodiment 2—OLED Panel in Dirigible—

A thin polymeric section of OLEDs can be incorporated into the exterior of the balloon for providing a display, these can be formed in multi-segment display areas so that less area need be covered, wherein the output may appear like balloon 2110 with segmented text 2112.

Embodiment 3—Ground Based Laser:

A simplified dirigible may be provided with graphics by generating a laser controlled on a three dimensional stage from a ground based location up to a surface of the dirigible. In order to display the message at the proper location on the dirigible the system incorporates means for locating said dirigible in three dimensions. The dirigible may be located optically, such as by processing the images received from an imager, such as CCD, directed toward the area of the sky where the dirigible is "posted". The imager detects the edges of the dirigible and converts these to limits for the laser display head which then can "paint" the image on the center of the derisible. In this configuration it is preferred that the dirigible have a symmetrical cross section so that rotation due to wind will not alter the size or shape of the "screen" provided by the dirigible. Other forms of detection may also be utilized, such as a reflection sensor coupled to the laser generator itself wherein it can detect if the generated light is being reflected, wherein it calibrates itself for dirigible position by periodically generating a crossing pattern (preferably a sufficiently low duty cycle as to not be apparent to observers) and detecting the boundaries of when light is reflected, these then become the limits of the light being generated.

Embodiment 4—Laser Splasher

An array of Lasers may be utilized in similar manner to that described within the laser sign embodiments described above, however, the weight factor and cost may be prohibitive for smaller dirigibles.

Embodiment 5—USLED

The USLED format may be utilized, in particular with a sparse array of SMT LEDs or organic led material formed on the dirigible. Wherein the signals for controlling the message may be carried over the power and ground that connects to the dirigible. It should also be appreciated that the LEDs need not cover the surface of the item and may be constrained to follow a pattern such as found on 17 segment character displays which allow text characters or numbers to be displayed. Using these limited patterns allows a reduction in the cost and weight of the display.

Security Enhancements:

The units preferably include a monitoring device to notify personnel if the unit is tampered with or malfunctions. Security on the ground should protect the cable from tampering and be configured to sound an alarm/alert if an intrusion is detected. Furthermore, the controller should be provided to generate an alert, which preferably generates a call through a security service with synthesized voice if problems are detected, such as cable breakage, or power loss. Furthermore, the tension on the cable is preferably registered by the controller, wherein decreases in average cable tension (it makes allowances for wind produced variations) cause an alert to be generated. This is significant because if the unit has sprung a leak, it is important that someone be dispatched to retrieve the dirigible before it hits the ground.

To reduce the chances of the dirigible floating away, for instance if cable breaks, the unit is preferably provided with an outflow valve that is retained in a closed position only so long as signals, or power, from the ground station through the cable are being received. If the cable breaks then the valve opens and the dirigible rapidly deflates. The dirigible may additionally, or alternatively, be configured with a homing device wherein upon disconnecting an RF beacon is activated which emits a signal that may be found by triangulation, or preferably includes a GPS circuit wherein the coordinates of the unit are transmitted periodically to assure that the unit may be recovered promptly.

Of course it is preferably that the unit be designed with multiple chambers so that a single incident, such as a bird strike, or bullet, would not cause a rapid descent of the unit.

22.0 Remote Data Dump for Displays.

To simplify the loading of active displays with messages.

Active displays in various forms are proliferating. Generally these displays are connected to a central location from which they receive display instructions. However, connecting signal wiring to a remote display that need to be changed infrequently is often very costly.

The present invention allows for the use of a conventional programmable device, such as a PDA, to be used for downloading display data to a display that is not connected to a programming source.

The message to be displayed is generated by a computer system, such as indicating what movies are playing each screen within a multiscreen complex. These messages are then downloaded to a PDA running the "display dump" application of the present invention. The information may be downloaded to the PDA via a wired port, such as USB, or a wireless port such as IR or RF. A security code for each display is preferably included within the download, as each individual display unit is preferably configured not to response to the receipt of any transmission that does not contain the security coding. The information for each display is downloaded into a separate file within the PDA which is labeled according to the number of the display, or other distinguishing feature, (i.e. screen number in this case).

Once downloaded an employee may make the rounds to change the signs. If the PDA and signs are configured to communicate using IR, then the PDA must be directed at a particular sign, wherein the user after having selected on a menu which display is to be programmed, can press an activate key wherein the communication with the remote display commences. The process is similar for an RF communication, however, the PDA need not be directed at the display and only in the vicinity thereof.

The controls for the device are preferably shown on the display of the PDA wherein the user interface allows single click operation as the employee follows a given pattern from one display to the next downloading the new messages to be displayed.

Less preferably the unit could be built as a standalone unit with a unit selector code and display and control buttons, however, the use of a PDA can significantly reduce the engineering efforts while providing a multipurpose device that may be utilized for a variety of applications.

23.0 Fau-Neon Signs.

Advantages of neon signs without the cost and low duration. Neon signs are made from fragile glass tubes filled with neon and require high voltage drive transformers.

Currently a professional is required to create a neon sign as well as specialized equipment. Furthermore the neon signs suffer from a limited lifespan that is far less than what can be expected from LED light sources. In addition a segment of neon light is either on or off wherein special effects are not possible.

Methods are described for creating neon signs from strips of LED, or other light emitting elements. (The description will refer to LEDs as this is the most common light emitting element to be used at this time.) The LEDs utilized are preferably capable of being addressed universal synchronous USLEDs driven according to the application "A system and method of driving an array of optical elements" Ser. No. 09/924,973 filed Aug. 7, 2001 and provisional application Ser. No. 60/223,659 filed Aug. 7, 2000, which are included herein by reference. Although conventional LEDs may be utilized, they would lack the ability to be controlled individually or in segments.

A fau-neon sign may be created from a bendable mounting strip that contains light generating elements. The bendable mounting strip is fabricated from a base material having at least one pair of conductors to which the LEDs may be electrically connected. It is preferred that the LEDs be premounted to the mounting strip so that laborious hand assembly of the LEDs is not required. Preferably the material is configured to facilitate bending without inducing failure of the connection between the LED and the bendable mounting strip. The bendable mounting strip with the mounted LEDs may be cut and bent to shape to form various designs, lettering, and so forth. Once bent to shape the elements may be glued together and the conductors connected between each segment. The display may be potted within a clear material, such as resin to protect the elements and conductors. The potting may encompass the entire sign, such as forming a plate surrounding the devices, or to improve the optical properties, sections of tubing may be placed around the portions of the display into which resin is injected. After the resin hardens the tubing may then be stripped away and a fau-neon sign results that has a circular cross section in a similar manner as existing neon signs. It should be appreciated that each segment may be individually potted, such as within a surrounding tube, and the resultant potted segments be connected and glued.

Figure 31:
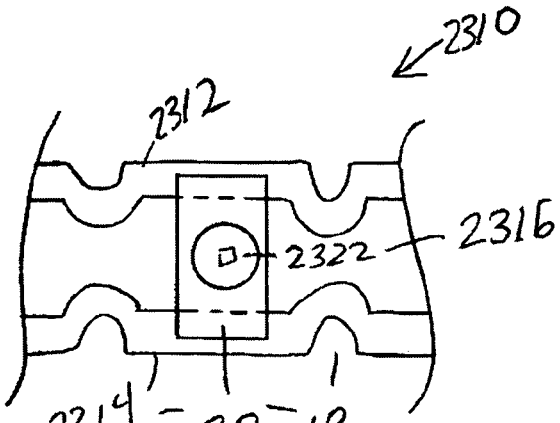
FIG. 31 is a top view of a fau-neon sign according to an embodiment of the present invention.
Figure 32:
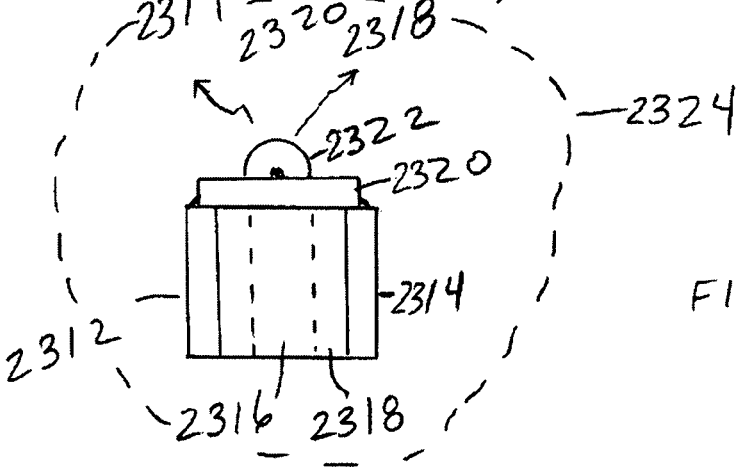
FIG. 32 is a side views of the fau-neon sign of FIG. 31 shown according to an aspect of the present invention.

FIG. 31 and FIG. 32 illustrate a magnified view of a strip of material 2310 having conductors 2312, 2314, attached to an insulator 2316. Preferably the strip of material is adapted for easy bending and cutting, such as exemplified by notches 2318 on the conductors. One method of fabricating these strips is by stamping out conductor portions 2312, 2314, and injecting an insulating material 2316 therebetween. A light emitting element 2320 is mounted across the conductors 2312, 2314. Light emitting element preferably comprises a surface mount LED having a dome lens 2322, although a number of other configurations may be utilized without departing from the present invention. The depth of conductors 2312, 2314, allow for significant current carrying capability with negligible ohmic losses, while providing a easy surface to facilitate soldering sections of the material to one another. A clear potting material 2324 is shown encapsulating the LED strips. It will be appreciated that colorants may be added to the potting material to modify the color being output by the light emitting element.

It will be appreciated that connectors may be fabricated to simplify making the connections between the sections within a fau-neon sign.

Figure 33:
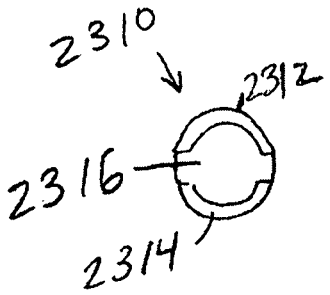
FIG. 33 is an end view of a elongate retention element for retaining LEDs within a fau-neon sign according to an aspect of the present invention.
Figure 34:
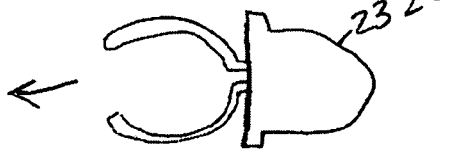
FIG. 34 is a side view of an LED element utilized for attachment to the elongate retention element of FIG. 33 according to an aspect of the present invention.

FIG. 32 through FIG. 34 depict another embodiment of the LED strip material 2310 having a circular cross section wherein a leaded LED may be mounted over a portion of the exterior of the element.

If it is desired to emit light from more than one side of the display then back-to-back elements may be placed on the bendable mounting strip. The polarity of the LEDs should be configured to match the polarity of the strip material. In addition, the bendable strips may be twisted wherein light may be output in all directions. The twisting may be performed by the user or the sections may be sold pretwisted.

24.0 Direct and Indirect LED Lighting. The display elements (LEDs) utilized are preferably capable of being addressed according as universal synchronous LEDs as described in the application "A system and method of driving an array of optical elements" Ser. No. 09/924,973 filed Aug. 7, 2001 and provisional application Ser. No. 60/223,659 filed Aug. 7, 2000, which are included herein by reference. Although conventional LEDs may be utilized, they would lack the ability to be controlled individually or in segments.

This aspect of the invention provides the following benefits:

(1) To provide enhanced lighting control using discrete lighting elements, such as LEDs.

(2) To provide readily controllable lighting utilizing LEDs, or other plurality of discrete lighting elements for use within stage and camera lighting.

(3) To provide remote control lighting in otherwise uncontrolled fixtures.

To improve the control and visual characteristics of lighting sources the present invention utilizes a combination of direct and indirect lighting (single color or multiple colors) from a single modular arrangement of LEDs or similar light emissive elements. (will be referred to herein as LEDs although other types of emissive lighting sources may be utilized).

FIG. 35 exemplifies an embodiment of a lighting module 2400 of the present invention, adapted with a first emissive surface oriented in a first direction, such as populated with a plurality of LEDs, and a second emissive surface oriented in a generally opposing second direction, again as preferably populated by a plurality of LEDs.

The first set of LEDs 2402 are directed at a reflector 2406, such as a curved mirrored surface, fresnel reflector, and so forth, wherein the light output is redirected in a generally opposing direction. The second set of LEDs 2404, on the lighting modules are directed in the second direction, such as through lens which is the same as the redirected direction of the light from said first LEDs.

An optional optical element 2410, such a diffuser, diffraction grating, and so forth may be interposed in front of the second set of LEDs to control how readily discernable the individual LED-light will be to the observer before passing through optional lens 2412, which may be used to protect the elements or to alter the direction or focus of the light from the light module.

The light module may be electrically connected to a power source, and optionally a controller, by a wired connection with the reflector, the lens, or other structural elements. Various patterns are produced by modulating the LED activation and intensity or when using multiple colors various color effects may be produced by modulating which LEDs are activated. The light output may be made to shift colors depending on which constituent LEDs are activated.

The state of each of the LEDs is preferably controllable individually, or within groups, clusters, and so forth, wherein the intensity, and patterns of the lighting may be regulated. For example, lighting fluctuations can be used to signal selected conditions or to provide a desired type of lighting. The LEDs, or similar emissive sources, may therefore incorporate USLED circuits as described, or other forms of element control circuits.

(2) One preferred embodiment for LED lighting is within stage and movie lighting, wherein the lower level of infrared radiation output significantly can reduce perspiration by stage personnel.

LEDs are distributed in bank modules directed at the stage, or retained within a still or video camera directed at a subject. The LEDs may optionally be fitted with lenses to direct the light output to the correct area of the stage. The LEDs within the bank may be assembled into clusters wherein fewer lenses are required to direct the lighting to the stage, or other performance area.

The above direct and indirect configuration of lighting may be utilized for controlling fill lighting and spot lighting within the same light element.

To control intensity the output of the LEDs may be controlled in an analog manner, a digital manner such as PWM, or by selectively activating portions of the LEDs. The light being generated can provide special effects, such as twinkling by modulating the lights in a random manner.

(3) Remote Controlled Lighting:

Often it is desirable to regulate the light intensity or effects being generated by a light fixture, or other light power connection, which has been otherwise configured to provide a fixed output, or a single axis of control such as intensity.

For example such as for controlling the intensity of lighting from a fixture that is hardwired, or connected with other lighting units whose intensity is not to be controlled. A second example, is the control of light intensity and light patterns on lights that allow such control, such as the LED based lighting described above, wherein the fixture has a fixed control, or an intensity control, but has no provisions for pattern control.

In these instances, a remote control element is coupled to the light fixture, or within the light element itself (often referred to generally as a light bulb, spot light, and so forth) which is capable of being controlled by a remotely generated signal. For example, a light control module that may be inserted into the light receptacle, which comprises a receiver configured to receive light control signals, a power modulation device responsive to said light control signals which modulates the intensity or pattern of said lighting. Intensity and/or patterns within the generated light may be modulated. Furthermore, the color of the light may be modulated by providing a series of LED colors and altering which LEDs (or other emissive elements) are activated to generate the desired color. Alternatively controllable filters may be coupled to the light to regulate the output color from the light source.

The receiver and controller for the lighting may be integrated into a module which plugs into an existing light fixture, a new light fixture providing the remote control circuits, or integrated within the light element itself as which electrically connects into the lightfixture.

The controller preferably comprises a simple microcontroller coupled to a receiver element which determines which commands have been received and modulated the lighting element accordingly. It should be appreciated that the lighting controller may be implemented according to the USLED techniques described above. The controller is coupled to a power controller circuit, such as power FET, or other device, which can be configured to switch On and Off a single, or multiple lighting elements, or to modulate the voltage applied to a single or multiple lighting elements to provide analog control of intensity.

FIG. 36 and FIG. 37 is simple example 2450 having a receiver/controller 2452 connected to a conventional lighting system receptacle 2454 as shown connected to an AC power source through a power switch. The receiver/controller may be integrated within the lighting fixture, or within a module which is received within the lighting receptacle and into which the lighting element is to be inserted (i.e. coupled in the same manner as the light element to be powered), or within the lighting element itself.

FIG. 37 depicts a block diagram of the circuits within the receiver controller, with a receiver 2456, microcontroller 2458, power supply 2460 connected from a power line control 2462. The receiver is preferably a coded RF receiver, although optical sensors (IR sense or visible light sensing) and acoustic sensors may be less preferably utilized.

Although IR control may be generally less preferable, in select applications it may be more desirable, as a single control unit can be made to control a series of lights in response to pointing of the remote control to the particular light element to alter its output characteristics. The IR light input therefore does not require the use of multiple radio channels or codings for determining which lighting element among a number is to be controlled.

25.0 LED array lighting enhancement. Enhances the visual appeal of LED lighting arrays, such as in traffic lights and similar arrays of elements.

LED arrays are often implemented somewhat sparsely for cost considerations, for example the circular LED arrays found in a traffic light. The sparseness of an array diminishes the recognition of the array and generally is less aesthetically pleasing. The present invention provides a couple of easily implemented mechanisms to improve the viewing qualities of sparse LED arrays.

Figure 38:
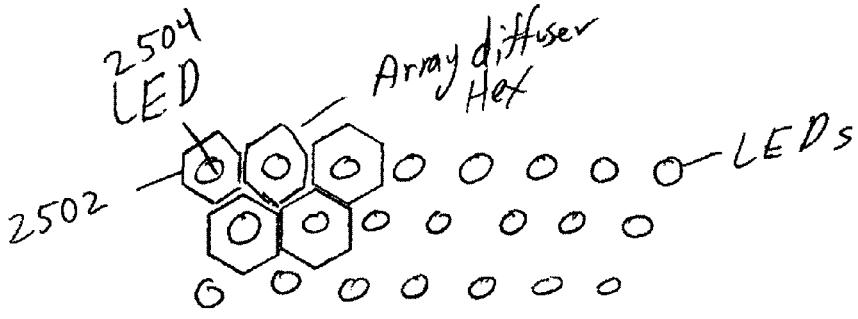
FIG. 38 is a facing view of individual hexagonal LED lighting diffusers according to an aspect of the present invention.
Figure 39:
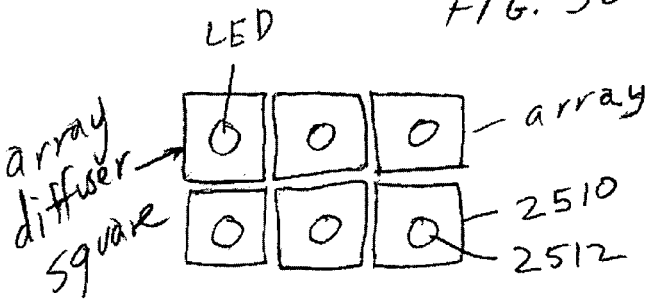
FIG. 39 is a facing view of individual square LED lighting diffusers according to an aspect of the present invention.
Figure 40:
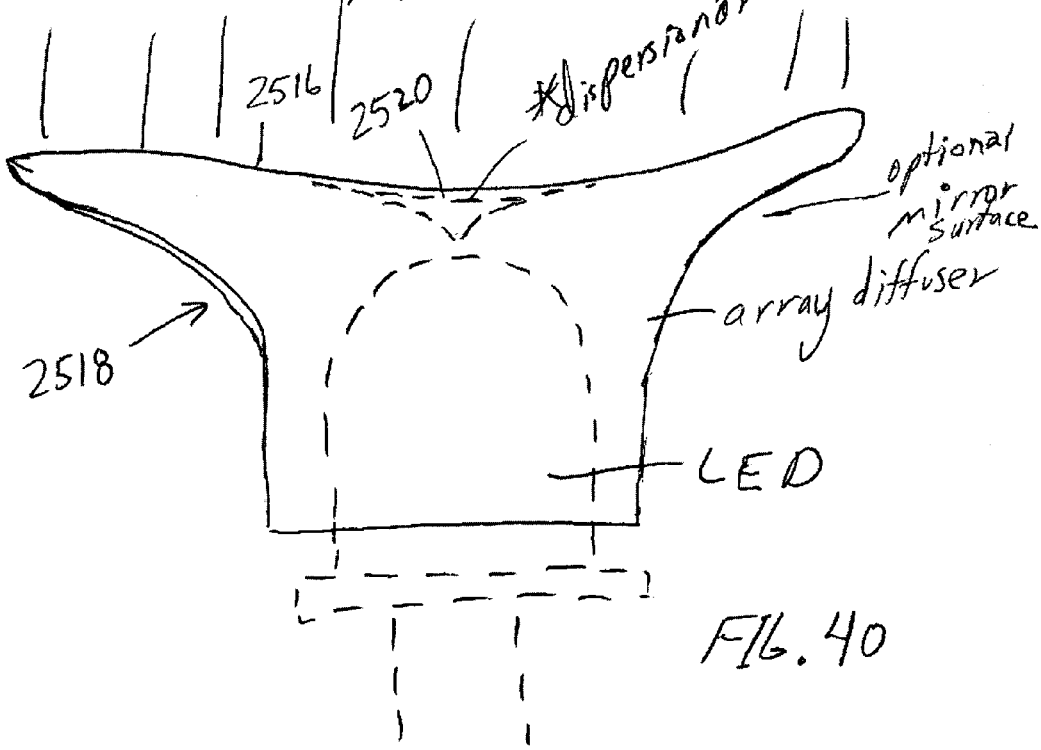
FIG. 40 is a side view of a single LED diffuser according to an aspect of the present invention, showing a shape, by which the optical light is diffused.

(1) A plurality of diffusers configured for use in an array of a particular grid shape and pitch. FIG. 38 depicts hexagonal diffusers 2502 attached to each of a plurality of 2504 LEDs within an array. FIG. 39 depicts square diffuser array elements 2510 attached to LEDs 2512. It should be appreciated that any shape or size diffusers may be created to support a given sized and structured array. FIG. 40 exemplifies a preferred diffuser according to the present invention which is shown friction fit to a discrete LED. The hat shape 2516 provides sloping sides to aid in directing more light to the perimeter of the light. The underside 2518 of the diffuser is preferably coated with a reflective material, such as mirror surface to reduce lost light on the back side. The center of the diffuser 2520 may include a partially reflective region, preferably shaped as a sloping cone wherein a portion of the light striking this region is reflected toward the perimeter of the diffuser, to help in equalizing the light emissions. The choice to include the center diffuser depends on many factors, such as cost and size of the diffuser in relation to the LED being used.

Although shown for use on discrete LEDs the technique may be utilized on SMT and other LED form factors.

(2) The plurality of diffusers above may be integrated into a single unit, such as a integrated circular array of diffuser elements. This may be fabricated for example by jigging individual diffusers into an array matching the application, such as the circular unit for traffic lights and then applying a white or reflective coating to the backs of the diffusers. This process can thereby provide the integration of the units while preventing rearward light leakage. Keeping the elements generally separate improves the light pattern that may be produced as perimeter light exits that the perimeter of the single diffuser and is not passed through to another cell wherein it may exit at the center of the element.

26. USLED Additions/Enhancements.

This invention pertains generally to displays comprising an array of display elements and more particularly to a method and system wherein array address information is encoded within each display element wherein the elements may be controlled utilizing simplified driver circuits. The invention may be referred to as providing a form of Array Position Addressing (APA), that allows elements to be controllable addressed without the need of individual row and column lines.

The following application is incorporated herein by reference "A system and method of driving an array of optical elements" Ser. No. 09/924,973 filed Aug. 7, 2001 and provisional application Ser. No. 60/223,659 filed Aug. 7, 2000, which are included herein by reference.

Displays made using the USLEDs include all sorts including the one dimensional display arrays—light strings, branched light strings, and so forth.

Two dimensional display arrays may equally be created using USLEDs, such as for advertising signs (indoor and outdoor), system displays (athletic equipment, status displays, computer displays, and so forth), automotive displays and lighting (turn signals, brake lights, side indicators, etc.), stage lighting, and so forth.

Three dimensional display arrays—ornamental displays. The technique arbitrary complexity since to row and column lines and drivers are needed.

(1) Generic use of the synchronous optical programming (SOP) which may be utilized for any ordered, or non-ordered, plurality of devices. For example with output elements, such as displays, and with input elements, such as optical detectors, along with combinations thereof.

If desired, data may be read from the elements connected on the power plane carrying the piggyback addressing signal.

An open time slot after each address transition can be provided in which the controller enters an input state to read transients on the backplane, and each element then after decoding its address, and optionally setting a data output, can generate a data response to the controller within the timeslot window. The response is formatted in a similar manner as data arriving at the elements from the controller.

(2) Use with "linear" arrays of elements —

Elements that lie on a single string may be programmed in this manner. The same two axis USLED control circuit may be utilized, or a single axis control circuit configured to have only column driving. Use of APA according to the USLED method can be used to implement numerous single axis control situations. Example embodiment—Fau neon lighting with LEDs within a string that may be embedded within a plastic resin.

(3) Use with Randomly Disbursed Elements—

Elements which are not retained in a fixed pattern may be programmed by this method. The location is dependent on how the elements are programmed, wherein any complex pattern of lights may be supported.

Example—Icicle form of Christmas lights, wherein drop strings containing lights are connected to a lighted main string.

Example—items scattered on a surface, which are not regularly ordered, (wherein more than one element may respond in a given location) however the result is still useful.

(4) Specific Use with E-Paper—

An array of electric program heads may be disbursed on a sheet for programming an area of e-paper, or a linear array of elements over which the sheet is passed.

(5) Reducing Noise of the Signal Riding the Power Plane—

It will be appreciated that an inherent aspect of the present invention is that a solid ground plane is provided to reduce RFI. This ground plane section within the backplane can be faced toward the outside of the display to block RFI through the backplane while a metallic housing, or other form of ground plane used, to house the back side of the display and thus shield RFI generation. However, the following are additional aspects that may be considered in certain applications if further noise reduction is necessary.

As select applications may be sensitive to noise generated as a result of the signals riding the power plane a few application notes are in order.

The signal may be encoded in a number of alternative ways, such as modulation schemes such as delta modulation, wherein only pattern changes are sent over the plane. To minimize RF generation the modulation scheme utilized may be selected to reduce the sub-band modulation within the signal, such as by altering coding from cycle to cycle or using a rolling encoding scheme wherein the same waveforms are not repeatedly sent for a static display. Also power fluctuations may be averaged out by properly designing the encoding so that changes to the display outputs do not create significant noise feeding back through the power circuits.

(6) Arrays Created by Self-Assembly Methods—

The described USLED method is well suited to self-assembly processes wherein the USLEDs can be self-assembled onto a backplane (preferably a two-wire backplane). One form of self-assembly comprises floating packages over a surface wherein upon drawing off the liquid, and often subject to mechanically oscillating the surface, the packages having a shape that fits the surface in a predefined way become engaged in cutouts or detents in the surface and may then be retained using wave soldering, bonding materials, or overlays.

By way of example, in self assembling USLEDs, each USLED may be configured with a pyramidal base, (cross section being circular, square, triangular, hex, and so forth) that is heavier than the optical output side of the USLED. A pair of contacts would be provided along the height of the "pyramid" which upon assembly would make contact with the contacts within the backplane. For example a first contact may be located at the time of the pyramid and a second contact located at the base of the pyramid. After self-assembly securement and electrical contact for the USLED may be provided by soldering the two sides of the USLED to the backplane, (automated positional soldering, or wave soldering of the surfaces [although capillary action could result in bridging]), or using a conductive adhesive applied to each USLED on either side to secure and connect the USLED to the backplane.

It should be appreciated that although described in a simple configuration with but two planes, power and ground, over which the display signals are superimposed, the present invention may support any number of planes of the display by separating functions within the present invention to reside on a separate plane. For example, controlling each color on a separate plane, or controlling the programming voltages on a separate plane, and so forth.

The following are a few aspects of the invention which are considered to be patentable and for which claims are to be sought.

An LED with internal circuits for controlling output as described herein.

On USLED device:

display elements which are programmed to respond to a particular display address;

display element containing a programmable memory element for retaining addressing information;

display element sensing light to determine its position within a display array;

control circuit for USLED device;

controller for bank of USLED devices;

method of controlling a bank of display elements;

method of performing in-situ programming;

method of performing optical programming of the elements;

method of using the embedded signals on a power and ground plane to control display elements.

Dependent claims:

in-situ programming (optical, or by connection);

programming of device to a particular address prior to insertion;

traces not required to individual display elements, or to row and columns of the display, all elements within a portion of the display connected to the same power and ground traces.

base member containing only power and ground;

programmer for individual display elements;

method of isolating a bad USLED;

27. Usled Oleds.

Additional aspects relating to the universal synchronous display elements while referencing the other USLED and related sequential addressing described herein. This invention pertains generally to displays comprising an array of display elements and more particularly to a method and system wherein array address information is encoded within each display element wherein the elements may be controlled utilizing simplified driver circuits. The invention may be referred to as providing a form of Array Position Addressing (APA), that allows elements to be controllable addressed without the need of individual row and column lines.

The following items are incorporated herein by reference: "A system and method of driving an array of optical elements" Ser. No. 09/924,973 filed Aug. 7, 2001 and provisional application Ser. No. 60/223,659 filed Aug. 7, 2000, which are included herein by reference.

To reduce the addressing complexity within an emissive display, wherein the panel may be controlled from a single serial signal of sufficient bandwidth. Circuit layers are assembled on a substrate for the universal synchronous LED, or less preferably the Universal Sequential LED circuit. The substrate may comprise a conventional substrate material, form so of glass substrates, and flexible substrate materials such as polymeric materials. The circuit, as described in the USLED application may be configured to drive one or more elements, typically associated with a single pixel. It will be appreciated that simple digital circuitry such as required for manufacturing the USLED circuits may be fabricated on the polymers. The circuits may also be deposited onto a substrate such as using self assembly, autoplacing, or other convenient fabrication techniques.

It is preferable that aside from the power and ground supplied to each circuit, that at least one additional digital address line, and optionally signals for clocking, reset, row synch, and column synch, be added so that the circuit elements need not contain the needed circuitry for extracting these signals from the power bus, or other essentially muxed control lines. Although this may appear to complicate the simple circuits of USLED, it is readily achieved and reduces the myriad number of row and column lines that would otherwise need to be driven in a conventional flat panel.

The area of a large display panel may optionally divided into sections that utilize one or more separate addressing signals, if the refresh rate of a monolithic display would otherwise prove insufficient.

Rather than requiring the address for each cell to be optically programmed, as previously described, the cells may be programmed to fixed locations by any convenient method, such as by using a metal mask layer which configures address lines from the address comparator circuits to either high or low. By way of example the addresses may be set by using a mask step for setting addresses for each cell of the control circuit, for example, by connecting selected address lines to power which have been otherwise biased toward ground. It should be appreciated that this application is unlike that of discrete LEDs wherein it is unknown where they will be attached to the power and ground plane.

Figure 41:
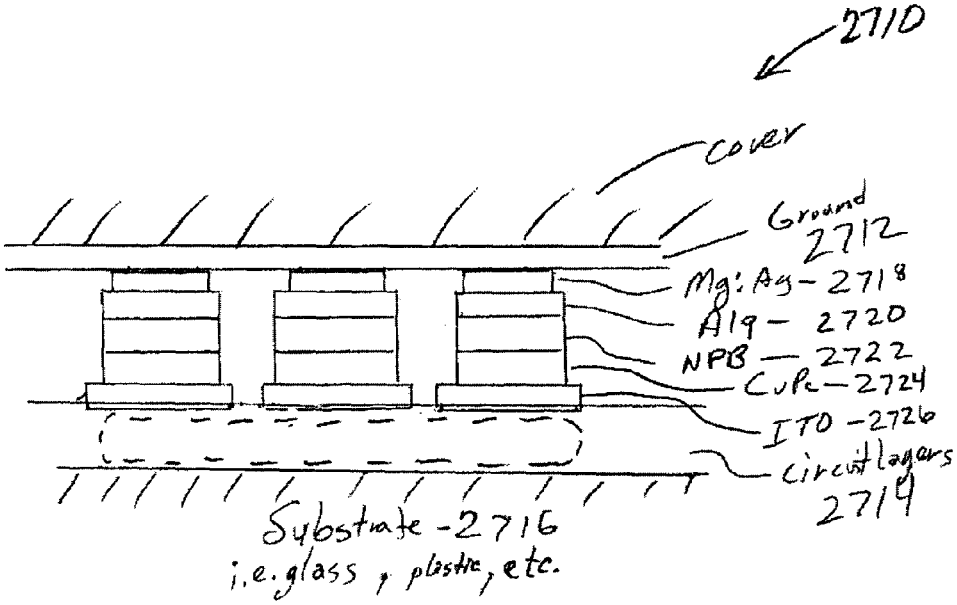
FIG. 41 is a cross section view of an organic LED (OLED) incorporating a selective (non-row/column) driver according to an embodiment of the present invention.

FIG. 41 exemplifies an OLED structure built between a substantially transparent ground plane layer 2712, and a set of circuit layers 2714 fabricated over a substrate 2716. The circuit layers may be fabricated using a step and repeat process, or other form of fabrication to create a large area circuit. Layers 2718–2726 are shown for each pixel. The address settings at each position may be embedded into a single mask or in using an iterative method with a metalization mask portions of which are modulated for the addresses for sequential portions of the display. It will be appreciated that a number of alternative methods may be utilized for constructing OLEDs that are controlled using techniques taught for USLED display control, without departing from the present invention.

The USLED control logic is embedded within the circuit layers on the substrate upon which the OLEDs are constructed thereby minimizing the need to route addressing lines, and for multiplexing the pixels of the display.

28. USLED in a Surface Mount Configuration

Additional aspects are described for USLEDs which pertains generally to displays comprising an array of display elements and more particularly to a method and system wherein array address information is encoded within each display element wherein the elements may be controlled utilizing simplified driver circuits. The invention may be referred to as providing a form of Array Position Addressing (APA), that allows elements to be controllable addressed without the need of individual row and column lines.

Incorporated herein by reference is the application "A system and method of driving an array of optical elements" Ser. No. 09/924,973 filed Aug. 7, 2001 and provisional application Ser. No. 60/223,659 filed Aug. 7, 2000, which are included herein by reference.

To allow for the creation of display panels of surface mounted LEDs, or other emissive elements, without the necessity of providing physical row and column addressing.

Surface mountable USLEDs using any convenient non-through hole package, or other emissive display elements, (herein just referred to as being SMT USLEDS) are mounted on simple backplanes. Each SMT USLED comprises one or more LED elements that are connected to a (USLED) circuit for performing the decoding of the APA signal and the intensity control of the LEDs to which it is connected.

The SMT USLEDs may be configured using the preferred 2 wire bondout as described for use with the leaded USLEDs described in the original USLED application. The backplane for connecting the two wire SMT USLEDs may be fabricated conventionally or with any convenient and preferably inexpensive method for routing a power and ground plane to the SMT USLEDs. A ground and power plane may be easily created on any surface by an additive process wherein a base material is either inherently conductive, or upon which a conductive material is adhered or applied, wherein an insulator may be formed upon which a second conductor may be fabricated. This additive process of fabricating a "circuit board" has been effectively utilized for the fabrication of low priced consumer goods such as calculators and the like. The lack of controllable resolution for the technique not being an impediment in the present application as the traces may be quite large.

The SMT USLED may be alternatively configured with additional connection, such as described for use with the OLED USLEDs, for selecting addressing and for receiving an address line separate from the power plane and/or one or more of the additional control signals, such as the clock, column synch, row synch, reset, and so forth. Even with separate control signals it will be appreciated that the circuit trace density is still quite low when compared to that which would be required with conventionally driven SMT LEDs. The address for each SMT USLED may be programmed into the device using the optical or other techniques described. The SMT USLEDs may also be programmed prior to or during the automated place operation.

If a multileaded SMT USLED package is utilized with sufficient leads for the addressing bits, then leads may be bonded out which may be pulled to either power or ground to establish the address for each position. Addressing in this manner is easily accomplished as a pattern may be created on the backplane that is either connected or non-connected to either power or ground for pulling selected addresses of the SMT USLED chip to either power or ground while the other leads are weakly biased otherwise. For example a pattern of conductive traces from an upper layer added power plane may extend to contact selected address lines which indicate to the SMT USLED what address it is located at on the display. It will be readily appreciated that a solid layer or liquid applied layers (that subsequently harden) may be added over a set of mounted SMT USLEDs for providing connections therebetween as well, however, the irregular surface generally reduces the effectiveness of this method.

29. Universal Sequential LED (or Other Output Elements)

To drive output elements that are individually addressed without the need to program each node or to provide address lines to each node. This invention is an off-shoot of the Universal Synchronous LED but has a different structure and is directed at different application areas.

The following items are related to the application "A system and method of driving an array of optical elements" Ser. No. 09/924,973 filed Aug. 7, 2001 and provisional application Ser. No. 60/223,659 filed Aug. 7, 2000, which are included herein by reference.

This display driver mechanism is similar to that of that of the USLED which references a programmed address value, such as in FLASH, to determine its address. Within the present invention however the elements are connected serially to one another and the address of a particular unit is determined by its position in the chain. The invention allows a single or multiple axis array of elements to be interconnected and addressed without the need of programming the address within each element. The present method is particularly well suited for use within arrays in which the elements are subject to low bandwidth changes or status updates.

A number of embodiments exist for applying the invention, the following are provided by way of example.

One of N Element Selector (ONES)

Allows for the selection of a single element, LED, mirror, etc. within a given group or subgroup of elements.

(1) Embodiment—Single row—Each element contains a counter chip and it derives a clock from the counter input. A counter value corresponding with the series position of the element to be activated, i.e. 100th element, is transmitted to the first of the series of elements. The first element counts down the value and since it is not yet zero, passes it to the next element, and so forth, until the value has reached a predetermined value (i.e. 0, or overflow) wherein that element then is activated directly (goes to active ON), or it picks up data from the signal such as setting information (i.e. intensity), timing information (i.e. ON time) or combinations thereof. The driven element may be optionally configured to turn off automatically after a fixed number of cycles, a number of cycles as read in the data, or be turned off upon receiving data set to an OFF level, or turned OFF when another element is selected.

The counter values sent out may be phase changes in a square wave signal, wherefrom a single line ties all elements and clocking is easily derived from the signals.

If state change synchronization is required, wherein the change of one element to ON must occur synchronous to another element being turned off, then a SET signal embedded within the clocking can be used to commence a new setting for a device just receiving data, while terminating the setting for an element that was previously active.

If synch is not critical then elements passing the data through can automatically be deactivated, however, a variable overlap of activation will occur as a result of position on the system.

Figure 42:
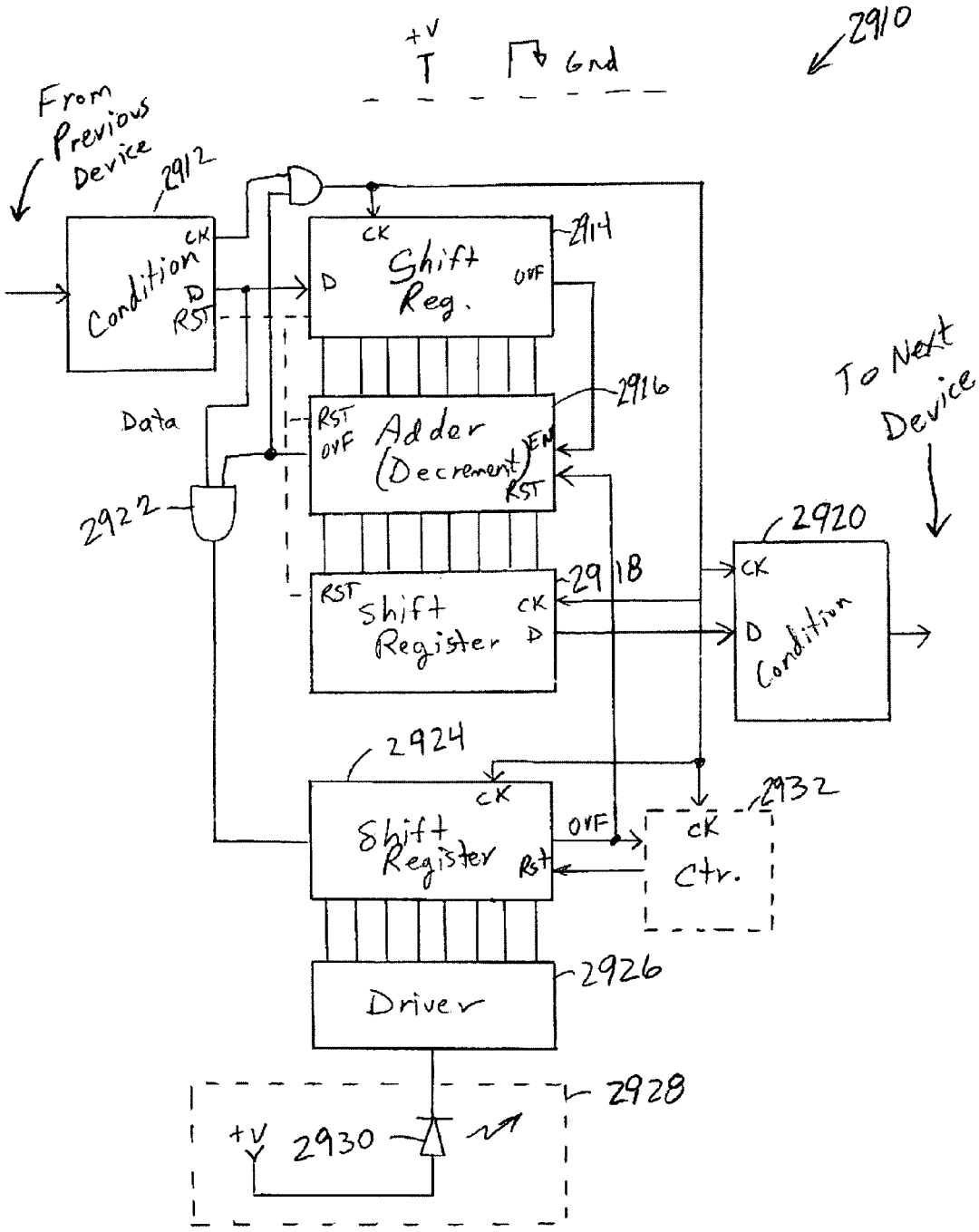
FIG. 42 is a schematic of a one-of-N display element control circuit according to an embodiment of the present invention.

FIG. 42 depicts a block diagram of an embodiment of the display control method and system 2910, with the circuit for a single element shown. It should be appreciated that the circuit is generally simplified to show the functions performed within the device and is not meant to be an actual schematic. Furthermore, a number of alternative embodiments will be readily apparent to one of ordinary skill in the art without departing from the present invention.

The circuit is preferably incorporated with an element to be controlled such as a display element, a MEMs device, or a device to be read. A single signal is shown being received within the device, this signal may include a clocking signal a serial address and a set of data. It will be appreciated that the multiple signal may be alternatively utilized although this increase the pin count. Furthermore, additional signals such as framing, reset (shown in a dashed line), and so forth may be incorporated without departing from the invention. A reset line may also be generated in response to the absence of data bits for certain length of time, wherein this assures that all circuits are reset to an initial condition, except for the previous display output setting. In addition the address bits may comprise multiaxis array addresses while any number and organization of data bits may be supported.

A signal containing clock and data are received by a conditioning circuit 2912 which separates the clock from the data with the data being passed to a shift register 2914. The diagram shows a circuit wherein a one bit is presumed to precede the address bits to be used for synchronizing the elements and a one bit is again added to precede the outgoing bits. Once the address is loaded in the shift register, which for example may be detected by the overflow of the start bit, the parallel output from the shift register is decremented within an adder 2916 (although it could be incremented instead using a complementary address value). If the address does not meet the selection criterion, which in this case require the address to have reached an underflow value, the result of the decrement is loaded into a shift register 18 for output through an output conditioning unit which combines the data and clock for output to the next device If however the address has underflowed, indicating that this element is being selected for output (or alternatively input) then the overflow signal gates on 2922 the shifting of a set of data bits that comprise the desired output from the conditioning circuit 2912 to an output control shift register 2924 whose output is provided to a driver circuit 2926 for controlling an element 2928, exemplified as an LED style element. An optional counter circuit 2932 is shown that may be used to deactivate the display output after a given number of clocks, so that the element need not be addressed again for turning off the element.

It should be appreciated that the parallel decrementing of the address may be replaced with a serial form of addition/subtraction, such as may be facilitating using a gray scale coding or similar to reduce the necessary bit conversions.

(2) Embodiment—Additional element axis—Additional element axis may added. For example a two dimensional array of one of N selection.

The count value contains a value for each axis—such as two counters for a two-axis array of elements.

A number of horizontal rows of elements are connected to a vertical row of null-column elements which will only decrement the row number and pass the data along. The null-column element may pass the counter value only if it reached the predetermined row count setting (selects the appropriate row) or it may pass them all along wherein only the individual elements within the correct row can reach a correct value for both the column and row.

(3) Embodiment—Few of N Element Selector (FENES)

If overlapping of activation is allowed, or maybe a small number of active elements are supposed to be active, then the scheme may be slightly altered to cover this application.

(a) Allow elements to stay on for a programmed period of time. Wherein the data following the properly decremented (or incremented) count indicates the time that the element is to stay active, optionally in addition to setting information (i.e. intensity).

(b) Require elements to be deactivated afterward by explicit setting. Preferably include a particular RESET count value that is propagated unchanged so that all elements may be set to a particular condition (ON, OFF, or other predetermined setting).

Selection of mirrors—

The correct mirror may be selected using a timing structure as found in the USLED application. Address for each consecutive mirror may be selected by surface etching away address selection bits of each mirror, or applying a conductive material (thick film or similar) to create address bits, so that a common circuit for driving the mirror may be utilized. (no optical programming is necessary).

Count down addressing—requires power and ground ALONG WITH an input and output line for each cell (1–N). A count value x is input for cell 1 which decrements the count to x=x−C (wherein C is a positive or negative constant). If the count has reached a predetermined value, such as zero, then the given cell is selected and retrieves the data following the count value. Otherwise the modified count and unchanged data passes out to the following cell. This approach allows for the creation of single and multiple axis array addressing without the need of addressing each cell, the address is inherent within the relationship between the cells. In a two dimensional array (Row and Column), two count values are provided along with one or more associated data values. An initial Column is set as an intersection of a set of rows and does not contain an associated element. It modifies the Row count, and passes along the associated column count ONLY to the correct row.

It will be appreciated that the controller may update the data immediately after a prior piece of data, it need not wait for synchronization and so forth.

The method is suited for use in systems wherein a 1-of-N selection arrangement is required, such as in arrays of mirror assemblies wherein only one element is to be selected for directing an optical beam.

The invention claimed is:

1. A data storage media having rewritable printed surfaces, comprising:

an electronic storage media upon which data may be recorded;

a first electrode covering at least a portion of a first surface on the exterior of said storage media;

electronic ink deposited over at least portions of said first electrode;

wherein a background electrode contact of an external programming device is coupled to said first electrode and configured for receiving a bias voltage upon physical contact with said external programming device;

wherein areas of said electronic ink are configured to be set to one of at least two optical states by an electrode array of the external programming device into which said media is received, said electrode array having a plurality of pixel electrodes presenting a sufficient voltage field in relation to said first electrode to change the optical state of said electronic ink thus printing a rewritable label on said media.

2. A media as recited in claim 1, wherein said media has a form factor conforming to CD or DVD media formats.

3. A media as recited in claim 2, wherein a conductor connects from said first electrode to areas near the spindle hole or the periphery of the media allowing a programming device to make electrical connection with said first electrode to create voltage fields between said first electrode and said electrode array for programming the electronic ink state.

4. A media as recited in claim 1, further comprising at least one area electrode on an opposite side of said electronic ink from said first electrode, said area electrode configured to set or reset the optical states of large areas of the electronic ink in response to programming voltage coupled between said first electrode and said area electrode.

5. A media as recited in claim 4, wherein said area electrode comprises a transparent electrode grid.

6. A media as recited in claim 1, wherein said media is configured for establishing electrical contact with the conductive layer from either side of the disk.

7. A media as recited in claim 1, further comprising angle marks encoded onto the disk for discerning a position of the disk during "printing".

8. An apparatus for printing rewritable labels on the surface of a data storage media, comprising:

a base member configured for physically engaging the exterior of a data storage media with label regions containing electrically programmable ink;

at least one contact on said base member configured for making contact with a first electrode within the media;

an electrode array retained by said base member in close proximity to the surface of said electrically programmable ink;

a means for instilling relative motion between said electrode array and a media retained by said base, wherein said electrode array passes over areas of the electrically programmable ink whose optical state is to be set in printing a rewritable label on the media; and a control circuit electrically coupled to said electrode array and said at least one contact for establishing electrical connection with said first electrode;

wherein said control circuit is configured to modulate the voltages between the first electrode and the elements of the electrode array in response to the relative motion between said electrode array and said media, for selectively writing a label on said media in response to label data received by said control circuit.

9. An apparatus as recited in claim 8, wherein said base member comprises a slide-out media receiving drawer.

10. An apparatus as recited in claim 8, wherein said base member comprises a media access device having a clamshell media receiving mechanism.

11. An apparatus as recited in claim 8, wherein said base member comprises a hand-held labeling device that the user manually moves over the surface of the media.

12. An apparatus as recited in claim 8, further comprising means of user creation of label content that is to be printed on said media.

* * * * *